US009846392B2

(12) United States Patent
Noguchi et al.

(10) Patent No.: US 9,846,392 B2
(45) Date of Patent: Dec. 19, 2017

(54) DEVELOPING DEVICE FOR PREVENTING DENSITY UNEVENNESS AND DEVELOPER OVERFLOW

(71) Applicant: CANON KABUSHIKI KAISHA, Tokyo (JP)

(72) Inventors: Akihiro Noguchi, Toride (JP); Mitsuhiro Furukawa, Chofu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/152,056

(22) Filed: May 11, 2016

(65) Prior Publication Data

US 2016/0334736 A1 Nov. 17, 2016

(30) Foreign Application Priority Data

May 15, 2015 (JP) ..... 2015-100289

(51) Int. Cl.
*G03G 15/09* (2006.01)
*G03G 15/08* (2006.01)

(52) U.S. Cl.
CPC ..... *G03G 15/0928* (2013.01); *G03G 15/0812* (2013.01); *G03G 15/0893* (2013.01)

(58) Field of Classification Search
CPC ..... G03G 15/0928; G03G 15/0812; G03G 15/0893
USPC ..... 399/274
See application file for complete search history.

(56) References Cited

U.S. PATENT DOCUMENTS 3,991,712 A * 11/1976 Genthe ..... G03G 15/0801 118/636
5,682,584 A * 10/1997 Hattori ..... G03G 15/0822 399/255
6,546,222 B2 * 4/2003 Sakemi ..... G03G 15/0928 399/276
6,725,007 B2 * 4/2004 Igarashi ..... G03G 15/09 399/267
8,548,361 B2 * 10/2013 Noguchi ..... G03G 15/081 399/119

FOREIGN PATENT DOCUMENTS

JP 5-333691 A 12/1993
JP 11194605 A * 7/1999
JP 2002139916 A * 5/2002
(Continued)

*Primary Examiner* — Robert Beatty
(74) *Attorney, Agent, or Firm* — Canon U.S.A., Inc. IP Division

(57) ABSTRACT

A magnet roller employs a magnetic pole pattern in which a first magnetic pole arranged substantially opposing a regulating blade in an upstream side of a rotation direction of a developing sleeve and a second magnetic pole next to the first magnetic pole in the upstream side have the same polarity, an opposing member having surface roughness higher than at least a particle diameter of carrier is arranged opposing the magnet roller at a position where magnetic force between the first magnetic pole and the second magnetic pole next to the first magnetic pole in the upstream side is almost zero, and an apex of a partition wall provided between a developer bearing member and a developer conveying member provided in a first chamber is positioned below a region where magnetic force formed by the magnet roller is almost zero.

18 Claims, 10 Drawing Sheets

(56) References Cited

FOREIGN PATENT DOCUMENTS

| | | | | |
|---|---|---|---|---|
| JP | 2005003812 | A | * | 1/2005 |
| JP | 2006099084 | A | * | 4/2006 |
| JP | 2007-140138 | A | | 6/2007 |
| JP | 2007-163811 | A | | 6/2007 |
| JP | 2013-020062 | A | | 1/2013 |
| JP | 2014-032336 | A | | 2/2014 |

* cited by examiner

DEVELOPING DEVICE FOR PREVENTING DENSITY UNEVENNESS AND DEVELOPER OVERFLOW

BACKGROUND OF THE INVENTION

Field of the Invention

The present invention relates to an image forming apparatus which forms an image by using an electrophotographic method, and, in particular, relates to an image forming apparatus such as a copier, a printer, a facsimile machine, or a multi-function machine having functions thereof.

Description of the Related Art

In recent years, a color image forming apparatus such as a color copier or a color printer is increasingly demanded as an image forming apparatus of an electrophotographic type in the market. Further, it is demanded that the color image forming apparatus achieves an image forming speed comparable to that of a monochromatic image forming apparatus, image quality comparable to that of offset printing, more reduction in a size than before, a shorter interval for maintenance, and reduction in running cost.

In response to these demands, a function-separated developing device, in which a developing chamber for supplying developer to a developer bearing member and a stirring chamber for collecting the developer from the developer bearing member are separated, can be used.

A developing device uses, as developer, two-component developer having non-magnetic toner particles (toner) and magnetic carrier particles (carrier) in some cases. Such a developing device is widely used particularly in the color image forming apparatus, for example, because excellent hue is achieved since toner does not need to include a magnetic substance.

A function-separated developing device using two-component developer generally has a configuration as illustrated in FIG. 3 and FIG. 5. A developing device 400 has a developer container 41 in which developer is contained. The developer container 41 is divided into a developing chamber (developer conveyance path) 41*a* and a stirring chamber (developer conveyance path) 41*b* by a partition wall 410*c* extending in a vertical direction. A developer conveying and stirring screw 42 serving as a first developer conveying and stirring member and a developer conveying and stirring screw 43 serving as a second developer conveying and stirring member are respectively arranged in the developing chamber 41*a* and the stirring chamber 41*b*. At each end of a partition wall 41*c* in a longitudinal direction, each of openings (developer conveyance paths) 41*d* and 41*e* allowing passing of the developer between the developing chamber 41*a* and the stirring chamber 41*b* is provided. The first and second developer conveying and stirring screws 42 and 43 stir and convey the developer to circulate the developer in the developer container 41. A developing sleeve 440 as a developer bearing member is placed rotatably in the developer container 41 so as to oppose a photosensitive drum 1*a*. The developing sleeve 440 incorporates a magnet 45 as a magnetic field generating unit.

The developer is supplied from the developer conveying and stirring screw 42 to the developing sleeve 440. The developer passes through a gap between the developing sleeve 440 and a regulating blade 46 serving as a regulating member and the developer with a predetermined developer amount is supplied to a position opposing the photosensitive drum 1*a* in the developing sleeve 440. At this time, developer which could not pass through the gap exists on the developer container 41 side of the regulating blade 46. When an amount thereof is large, magnetic force by the magnet 45 in the developing sleeve 440 and force caused by rotation of the developing sleeve 440 cause great stress with respect to toner and carrier and a situation where deterioration easily occurs is brought. Thus, in order to reduce deterioration of the developer as much as possible, the magnet 45 by which a first magnetic pole and a second magnetic pole from the regulating blade 46 in the upstream side of a rotation direction of the developing sleeve 440 have the same polarity to reduce the amount of developer existing on the developer container 41 side of the regulating blade 46 can be used.

In a function-separated developing device 4, as illustrated in FIG. 3, as being close to the opening 41*d* through which the developer flows down, the amount of the developer existing in the stirring chamber 41*a* decreases and the developer in the stirring chamber 41*a* becomes unintentionally difficult to be supplied to the developer bearing member. Therefore, a supplying amount from the developer conveying and stirring screw 42 may lack so that density unevenness due to coating unevenness occurs. Further, when the magnet 45 is used for reducing the deterioration of the developer as described above, the density unevenness is more likely to occur.

A situation as described above is considered to become increasingly important as a printer or a copier using an electrophotographic method achieves higher speed and higher durability in recent years.

Thus, in an image forming apparatus of Japanese Patent Laid-Open No. 5-333691, described is a technique of sufficiently enhancing developer conveying ability of first and second developer conveying and stirring screws by increasing a rotation speed in order to stabilize coating property of a developing sleeve.

Further, in an image forming apparatus of Japanese Patent Laid-Open No. 2007-163811, described is a technique in which in order to achieve uniform height of a developer surface of developer in a longitudinal direction, a top surface of a partition wall serving as a bottom portion of a container is inclined such that an end of the bottom portion in a developer conveyance direction is higher than the other end.

However, the image forming apparatus in Japanese Patent Laid-Open No. 5-333691 has a situation that as the rotation speed of the developer conveying and stirring screws is increased to increase a developer conveyance amount, stress on the developer increases and a rotation torque increases, so that the rotation speed of the developer conveying and stirring screws is difficult to be increased largely.

In addition, in the image forming apparatus of Japanese Patent Laid-Open No. 2007-163811, at a part where the height of the partition wall is low, the developer falls down from between the developing sleeve and the partition wall, so that the developer is easily accumulated in a lower chamber serving as a second chamber. Thus, there is a situation of density unevenness due to drag, and further, occurrence of overflow of the developer due to inappropriate collection of the developer on the developing sleeve.

SUMMARY OF THE INVENTION

The invention has been made in view of the aforementioned situation, and provides a developing device capable of preventing density unevenness and occurrence of overflow of developer while ensuring coating property of developer on a developing sleeve in a function-separated developing device.

An aspect of the invention provides a developing device, including: a developer bearing member configured to bear developer including nonmagnetic toner and magnetic carrier and develops a latent image; a developer container configured to support the developer bearing member rotatably and contain therein the developer to be supplied to the developer bearing member, the developer container having a first chamber containing the developer therein, a second chamber being arranged below the first chamber and forming a circulation path, in which the developer is circulated, with the first chamber, and a partition wall partitioning the first chamber and the second chamber; a first conveying member, arranged in the first chamber, configured to convey the developer; a second conveying member, arranged in the second chamber, configured to convey the developer; a multipolar magnet which is arranged inside the developer bearing member; and a regulating member configured to regulate an amount of the developer borne on the developer bearing member; the multipolar magnet having a first magnetic pole which is arranged at a position opposing the regulating member or in an upstream side of a conveyance direction of the developer bearing member with respect to the position, and a second magnetic pole which is adjacent to the first magnetic pole in an upstream side of the first magnetic pole in the conveyance direction, and has the same polarity as that of the first magnetic pole, in which a peak position of magnetic force of the first magnetic pole is arranged above a center of the developer bearing member and a peak position of magnetic force of the second magnetic pole is arranged below the center of the developer bearing member, in which the partition wall has an opposed part opposing the developer bearing member along a circumferential surface of the developer bearing member, the opposed part having an apex positioned below an uppermost end of a low magnetic force region, in which the low magnetic force region, in which magnetic force is equal to or less than 50 gauss, is provided on a surface of the first developer bearing member which is on an upstream side of the first magnetic pole and on a downstream side of the second magnetic pole with respect to a rotation direction of the developer bearing member, and in which the opposed part has surface roughness higher than an average particle diameter of the carrier.

As above, it is possible to solve the aforementioned situations.

Further features of the present invention will become apparent from the following description of exemplary embodiments with reference to the attached drawings.

DESCRIPTION OF THE EMBODIMENTS

First Embodiment

An exemplary embodiment of the invention will hereinafter be described in detail with reference to drawings.

Figure 1:
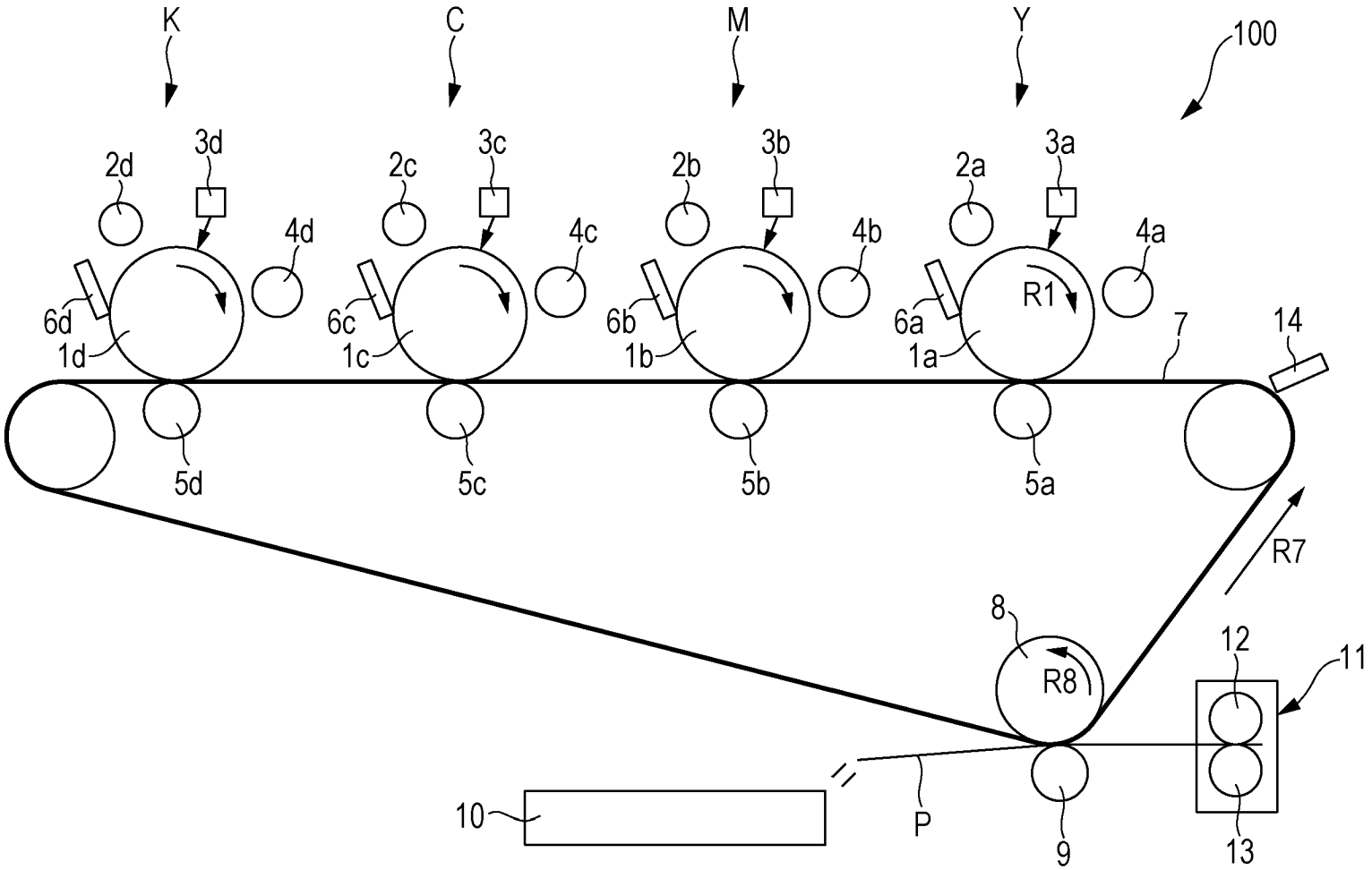
FIG. 1 illustrates a schematic configuration of an image forming apparatus according to a first embodiment of the invention.

First, an entire configuration and behavior of an image forming apparatus of the present exemplary embodiment will be described. FIG. 1 illustrates an image forming apparatus to which the invention is able to be applied. The image forming apparatus illustrated in FIG. 1 is a four-color full color image forming apparatus of an electrophotographic method having four image forming units, and FIG. 1 is a longitudinal sectional view schematically illustrating a schematic configuration thereof. Note that, the present embodiment is one aspect to which the invention is able to be applied and the invention is not limited thereto. In the image forming apparatus illustrated in FIG. 1, four image forming units (image forming stations) are arranged from an upstream side to a downstream side along a rotation direction (direction of an arrow R7) of an intermediate transfer belt 7 serving as an intermediate transfer member. The image forming units respectively include electrophotographic photosensitive members (hereinafter, referred to as "photosensitive drums") 1*a*, 1*b*, 1*c*, and 1*d* as image bearing members. The photosensitive drums 1*a*, 1*b*, 1*c*, and 1*d* form toner images in yellow, magenta, cyan, and black, respectively in this order. The photosensitive drums 1*a*, 1*b*, 1*c*, and 1*d* are driven to rotate in directions of respective arrows R1 (clockwise in FIG. 1). Arranged around the photosensitive drums 1*a*, 1*b*, 1*c*, and 1*d* are chargers (charging units) 2*a*, 2*b*, 2*c*, and 2*d*, exposure devices (latent image forming units) 3*a*, 3*b*, 3*c*, and 3*d*, developing devices (developing units) 4*a*, 4*b*, 4*c*, and 4*d*, primary transfer rollers (primary transfer unit) 5*a*, 5*b*, 5*c*, and 5*d*, and drum cleaners (cleaning devices) 6*a*, 6*b*, 6*c*, and 6*d* almost in this order along rotation directions of the photosensitive drums 1*a*, 1*b*, 1*c*, and 1*d*. The endless intermediate transfer belt 7 as the intermediate transfer member is laid across the primary transfer rollers 5*a*, 5*b*, 5*c*, and 5*d* and a secondary-transfer counter roller 8. The intermediate transfer belt 7 is pressed by the primary transfer rollers 5*a*, 5*b*, 5*c*, and 5*d* from the back side with its front side in contact with the photosensitive drums 1*a*, 1*b*, 1*c*, and 1*d*. The intermediate transfer belt 7 is configured to rotate in the direction of the arrow R7 as the secondary-transfer counter roller 8, which also serves as a driving roller, rotates in a direction of an arrow R8. The rotation speed of the intermediate transfer belt 7 is set to be almost the same as the rotation speed (process speed) of each of the photosensitive drums 1*a*, 1*b*, 1*c*, and 1*d*. A secondary transfer roller (secondary transfer unit) 9 is arranged at a position corresponding to the secondary-transfer counter roller 8 on the front surface of the intermediate transfer belt 7. The secondary transfer roller 9 and the secondary-transfer counter roller 8 hold the intermediate transfer belt 7 therebetween in such a manner that a secondary transfer nip (secondary transfer portion) is formed between the secondary transfer roller 9 and the intermediate transfer belt 7. A transfer material P intended for image formation is stacked and stored in a sheet feed cassette 10. A feeding and conveyance device including a sheet feed roller, a conveyance roller, and a registration roller (none of which is illustrated) supplies the transfer material P to the secondary transfer nip portion. A fixing device 11 having a fixing roller 12 and a pressure roller 13 pressed against the fixing roller 12 is arranged on the downstream side of the secondary transfer nip portion along the conveyance direction of the transfer material P. A sheet discharge tray is further arranged on the downstream side of the fixing device 11.

In the image forming apparatus having such a configuration, a four-color full color toner image is formed on the transfer material P in the following manner. First, photosensitive drum driving motors (not illustrated) drive the photosensitive drums 1*a*, 1*b*, 1*c*, and 1*d* to rotate in the directions of the arrows R1 at a predetermined process speed, and the chargers 2*a*, 2*b*, 2*c*, and 2*d* uniformly charge the photosensitive drums 1*a*, 1*b*, 1*c*, and 1*d* with a predetermined polarity and potential. The exposure devices 3*a*, 3*b*, 3*c*, and 3*d* perform exposure on the charged photosensitive drums 1*a*, 1*b*, 1*c*, and 1*d* based on image information, and electric charges at the exposed portions are removed to form electrostatic latent images of the respective colors. The developing devices 4*a*, 4*b*, 4*c*, and 4*d* develop the electrostatic latent images on the photosensitive drums 1*a*, 1*b*, 1*c*, and 1*d* into toner images in the respective colors of yellow, magenta, cyan, and black. The primary transfer rollers 5*a*, 5*b*, 5*c*, and 5*d* primarily transfer the toner images in the four colors onto the intermediate transfer belt 7 in their primary transfer nips successively. The toner images in the four colors are thereby superposed on each other on the intermediate transfer belt 7. The toner not transferred to the intermediate transfer belt 7 at the time of the primary transfer and left on the photosensitive drums 1*a*, 1*b*, 1*c*, and 1*d* (residual toner) is removed by the drum cleaners 6*a*, 6*b*, 6*c*, and 6*d*. The photosensitive drums 1*a*, 1*b*, 1*c*, and 1*d*, from which the residual toner has been removed, are subjected to the next image formation. The toner images in the four colors, superposed on the intermediate transfer belt 7 as described above, are secondarily transferred to the transfer material P. The feeding and conveyance device conveys the transfer material P from the sheet feed cassette 10, and the registration roller supplies the transfer material P to a secondary transfer nip T2 in synchronization with the toner image on the intermediate transfer belt 7. In the secondary transfer nip, the secondary transfer roller 9 secondarily transfers the toner images in the four colors on the intermediate transfer belt 7 to the supplied transfer material P by a single operation. The transfer material P to which the toner images in the four colors are secondarily transferred is conveyed to the fixing device 11. The fixing device 11 applies heat and pressure to the transfer material P to fix the toner images to the surface thereof. The toner left on the intermediate transfer belt 7 at the time of the secondary transfer (residual toner) is removed by an ITB cleaner 14. The transfer material P to which the toner images are fixed is discharged onto the sheet discharge tray. Thus, four-color full color image formation on one side (front surface) of one sheet of transfer material P is completed.

Next, two-component developer used in the present exemplary embodiment will be described.

The toner includes binder resin, colorant, colored resin particles containing other additives as required, and colored particles to which the external additive such as colloidal silica fine powder is externally added. The toner is a negatively chargeable polyester-based resin and may preferably have a volume-average particle diameter of 5 μm or more and 8 μm or less. The volume-average particle diameter was 7.0 μm in the present exemplary embodiment.

As the carrier, for example, surface-oxidized or un-oxidized metals such as iron, nickel, cobalt, manganese, chromium, rare earths; alloys of these metals; and oxide ferrite can be used. A manufacturing method of these magnetic particles is not particularly limited. The carrier may have a volume-average particle diameter of 20 to 60 μm, preferably 30 to 50 μm and may have a resistivity of $10^7$ Ωcm or more, preferably $10^8$ Ωcm or more. In the present exemplary embodiment, the carrier having the volume-average particle diameter of 40 μm, a resistivity of $5\times10^8$ Ωcm, and a magnetization level of 260 emu/cc was used.

Note that, with respect to the toner used in the present exemplary embodiment, the volume-average particle diameter thereof was measured by the following apparatus and method.

As a measuring apparatus, COULTER COUNTER TA-II (manufactured by Beckman Coulter, Inc.) was used by connecting to an interface (manufactured by Nikkaki Bios Co., Ltd) for outputting number average distribution and volume average distribution, and a personal computer. Further, as aqueous electrolytic solution, 1% NaCl aqueous solution prepared by using primary sodium chloride was used.

A measurement method is as follows. In detail, 0.1 ml of surface activating agent, preferably alkyl benzene sulfonate, is added as dispersant to 100 to 150 ml of the aqueous electrolytic solution, and a measurement sample of 0.5 to 50 mg was added.

The aqueous electrolytic solution in which the sample was suspended was subjected to dispersion treatment by an ultrasonic disperser for about 1 to 3 minutes. Particle size distribution of the particles in a range of 2 to 40 μm was measured by using the COULTER COUNTER TA-II fitted with a 100 μm aperture as an aperture, and volume average distribution was obtained. The volume-average particle diameter was obtained from the volume average distribution thus obtained.

The resistivity of the magnetic carrier used in the present exemplary embodiment was measured by using a method of obtaining the resistivity of the carrier from an electric current flowing through a circuit. Specifically, a cell of a sandwich type with a measurement electrode area of 4 $cm^2$ and an electrode-to-electrode interval of 0.4 cm was used, and a voltage E (V/cm) was applied between the electrodes under a pressure of 1 kg on one of the electrodes. The volume-average particle diameter of the magnetic particles was measured by using a laser-diffraction particle size distribution measuring device HEROS (manufactured by JEOL Ltd.) in such a manner that a range of a particle diameter of 0.5 to 350 μm is logarithmically divided into 32 on a volume basis. The numbers of particles in individual channels were measured. A volume 50% median diameter is defined as the volume-average particle diameter from the measurement result. The magnetic characteristics of the magnetic carrier used in the present exemplary embodiment were measured by using an instrument BHV-30 (manufactured by Riken Denshi Co., Ltd.) for automatically recording properties of oscillatory magnetic field. As a magnetic characteristic value of carrier powders, the magnetic strength of the magnetic carrier was obtained by forming external magnetic fields, which were 795.7 kA/m and 79.58 kA/m, respectively. A sample of the magnetic carrier for measurement was prepared by packing the magnetic carrier in a cylindrical plastic container so as to be sufficiently dense. In this state, the magnetizing moment was measured and further, an actual weight of the packed sample was weighed to obtain the strength of magnetization (emu/g). Further, the true specific gravity of the magnetic carrier particles was obtained with the use of, for example, an automatic densitometer of a dry type as Micromeritics Pycnometer Accupyc 1330 (manufactured by Shimazu Corp.) or the like. The strength of magnetization per unit volume was obtained by multiplying the obtained strength of magnetization by the true specific gravity.

Figure 2:
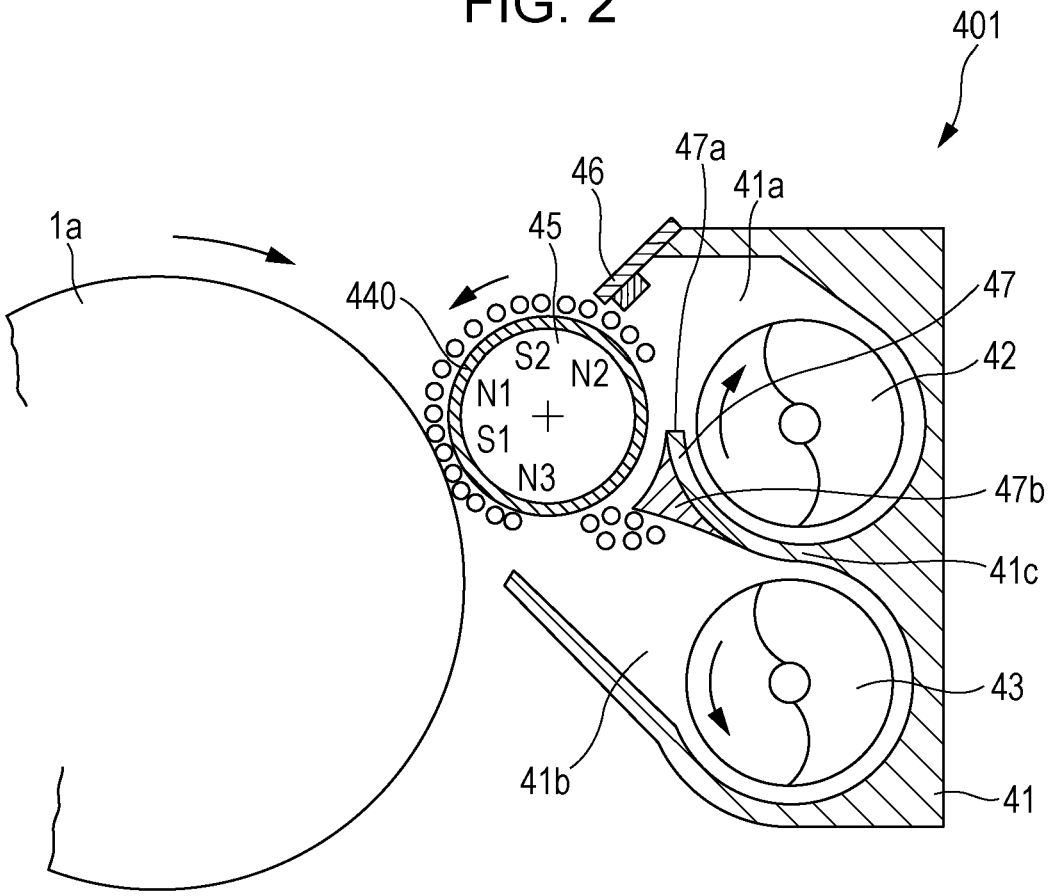
FIG. 2 is a transverse sectional view of a schematic configuration of a developing device according to the first embodiment.
Figure 4:
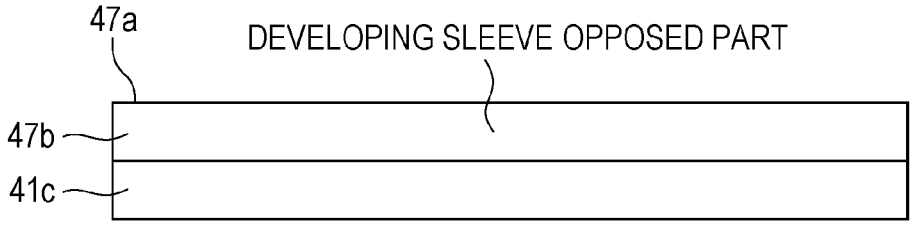
FIG. 4 is a plan view of an opposed member according to the first embodiment.

The developing device of the present exemplary embodiment will be described specifically with reference to FIG. 2 and FIG. 4. Note that, since respective developing devices used for a main body of the image forming apparatus of the present exemplary embodiment have the same configuration, description will be given only for one developing device. The developing device 4 in the following description may refer to any of the developing devices 4*a*, 4*b*, 4*c*, and 4*d*. FIG. 2 and FIG. 4 are sectional views of the developing device 4 according to the present embodiment.

The developing device 4 according to the present embodiment includes the developer container 41, and two-component developer including toner and carrier as described above is contained in the developer container 41 as the developer. A developing sleeve 440 as a developer bearing unit, and a regulating blade 46 for regulating magnetic brush of the developer borne on the developing sleeve 440 are provided in the developer container 41. A magnet roller 45 as a multipolar magnet is disposed in a non-rotating state inside the developing sleeve 440.

Figure 3:
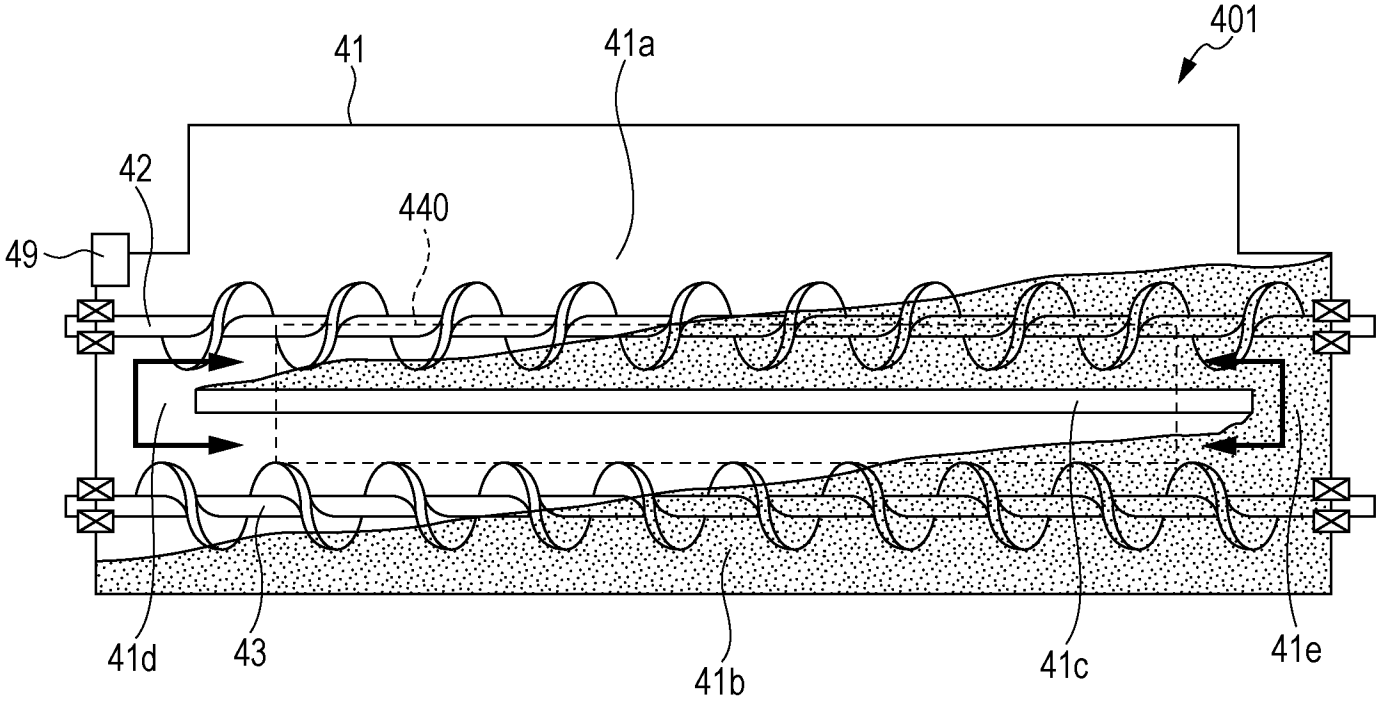
FIG. 3 is a longitudinal sectional view of the schematic configuration of the developing device according to the first embodiment.

In the present embodiment, the inside of the developer container 41 is sectioned by a partition wall 41*c* into a developing chamber 41*a* as a first chamber and a stirring chamber 41*b* as a second chamber at a substantially central portion of the developer container 41. The partition wall 41*c* extends in a direction perpendicular to the drawing sheet of FIG. 2. That is, the developing chamber 41*a* and the stirring chamber 41*b* are partitioned by the partition wall 41*c*. The developing device 4*a* of the present embodiment has a vertical stirring configuration in which the stirring chamber 41*b* is arranged below the developing chamber 41*a*, and the developer is contained in each of the developing chamber 41*a* and the stirring chamber 41*b*. At both ends of the partition wall 41*c* in an axis direction of the developing sleeve 440, openings 41*d* and 41*e* by which the developing chamber 41*a* and the stirring chamber 41*b* communicate with each other are respectively provided as illustrated in FIG. 3. In addition, a rising portion 47 which rises so as to be bent upwardly is formed on the developing sleeve 440 side of the partition wall 41*c*. The rising portion 47 is positioned between the developing sleeve 440 and a first conveying screw 42 described below.

The first conveying screw 42 as a first conveying member for conveying the developer while stirring the developer is arranged in the developing chamber 41*a* and a second conveying screw 43 as a second conveying member for conveying the developer while stirring the developer is arranged in the stirring chamber 41*b*. The first conveying screw 42 is arranged on a bottom portion of the developing chamber 41*a* so as to be almost in parallel to an axis direction of the developing sleeve 440, and rotates in an arrow direction (clockwise direction) of FIG. 2 to convey the developer in the developing chamber 41*a* in one direction along an axial line direction. The reason why the developer is conveyed in the clockwise direction is that it is advantageous from a viewpoint of the supply of the developer to the developing sleeve 440. In addition, the first conveying screw 42 is arranged so that a center thereof is positioned between an upper end and a lower end of the developing sleeve 440. In the present embodiment, the first conveying screw 42 is arranged adjacent to the developing sleeve 440 in a substantially horizontal direction. The second conveying screw 43 is arranged on a bottom portion in the stirring chamber 41*b* so as to be almost in parallel to the first conveying screw 42, and rotates in a direction opposite to the first conveying screw 42 (counterclockwise direction) to convey the developer in the stirring chamber 41*b* in a direction opposite to the first conveying screw 42.

In this manner, being conveyed with the rotation of the first conveying screw 42 and the second conveying screw 43, the developer is circulated between the developing chamber 41*a* and the stirring chamber 41*b* through openings (communicating portions) 41*d* and 41*e* at the both ends of the partition wall 41*c*. That is, a circulation path of the developer is formed by the developing chamber 41*a* and the stirring chamber 41*b*. By stirring and conveying the developer in the circulation path, the toner is charged. The developer conveyed to the developing chamber 41*a* is supplied to the developing sleeve 440, and absorbed and borne on the surface of the developing sleeve 440 by a magnetic field formed by the magnet roller 45 arranged inside the developing sleeve 440. Specifically, by performing charging so that the toner and the carrier have opposite polarities to each other, the toner is adhered to the surface of the carrier having a sufficiently larger particle diameter than that of the toner. Then, the magnetic carrier to the surface of which the toner is adhered is absorbed and borne on the surface of the developing sleeve 440 by the magnetic field formed by the magnet roller 45. The developing sleeve 440 is rotationally driven to convey the developer borne thereon to a part opposing the photosensitive drum 1*a* (developing unit).

In the present embodiment, there is an opening at a position corresponding to a development region opposing the photosensitive drum 1*a* of the developer container 41, and the developing sleeve 440 is arranged rotatably so as to be partially exposed from this opening in a direction of the photosensitive drum 1*a*. Here, a diameter of the developing sleeve 440 is 20 mm, a diameter of the photosensitive drum 1*a* is 80 mm, and a closest region between the developing sleeve 440 and the photosensitive drum 1*a* is about 300 μm. Due to this configuration, the development is able to be performed in a state where the developer conveyed to the developing unit by the developing sleeve 440 is in contact with the photosensitive drum 1*a*. That is, by making the developer borne on the developing sleeve 440 contact with the photosensitive drum 1*a* and applying a predetermined developing bias to the developing sleeve 440, an electrostatic latent image formed on the photosensitive drum 1*a* is developed with the toner. The developer remaining on the developing sleeve 440 after the development is collected in the stirring chamber 41*b*. That is, the developing device 4*a* of the present embodiment has a so-called vertical stirring function-separated configuration having the developing chamber 41*a* which supplies the developer to the developing sleeve 440, and the stirring chamber 41*b* which is arranged below the developing chamber 41*a* and collects the developer from the developing sleeve 440.

Note that, a toner inlet for replenishing the toner is provided at a part of the stirring chamber 41*b*. A developer replenishing device (not illustrated) is connected to the toner inlet so that, for example, the toner amount consumed by development is replenished into the developer container 41. The toner inlet is generally provided in the stirring chamber 41*b* in order to stabilize a toner charge mount by stirring the toner and the carrier as much as possible until the developer is supplied from the developing chamber 41*a* to the developing sleeve 440.

Next, configurations of the developing sleeve 440 and the magnet roller 45 of the present embodiment will be described specifically. First, arrangement of magnetic poles of the magnet roller 45 will be described.

[Arrangement of Magnetic Poles]

As illustrated in FIG. 2, the magnet roller 45 has a plurality of magnetic poles S1, S2, N1, N2, and N3. A position at which a reference sign of each of the magnetic poles is described in FIG. 2 indicates a position at which magnetic force of the corresponding magnetic pole substantially reaches peak. The magnetic pole S1 is a developing pole arranged in the developing unit opposing the photosensitive drum 1*a*. The magnetic pole N2 as a first magnetic pole is arranged at a position substantially opposing the regulating blade 46 in the upstream side of the regulating blade 46 with respect to the rotation direction (conveyance direction) of the developing sleeve 440. The magnetic pole N2 is arranged so that the peak position of magnetic force is above the center of the developing sleeve 440. The magnetic poles S2 and N1 are arranged between the magnetic pole S1 and the magnetic pole N2. The magnetic pole N3 as a second magnetic pole is arranged in the downstream side of the magnetic pole S1 in the rotation direction of the developing sleeve 440. The magnetic pole N3 is arranged so that the peak position of magnetic force is below the center of the developing sleeve 440.

In the case of the present embodiment, the magnetic poles N2 and N3 are arranged so that the center of the first conveying screw 42 is positioned between the magnetic pole N2 and the magnetic pole N3 which are repulsive poles in a vertical direction. In other words, the first conveying screw 42 is arranged so that the center thereof is below the peak position of the magnetic force of the magnetic pole N2 and above the peak position of the magnetic force of the magnetic pole N3. The arrangement of the magnetic poles of the magnet roller 45 of the present embodiment is characterized in that the magnetic pole N2 arranged in the developing sleeve 440 so as to substantially oppose the regulating blade 46 and the magnetic pole N3 next to the magnetic pole N2 in the upstream side (upstream side in the conveyance direction) have the same polarity. The developer borne on the developing sleeve 440 is separated from the surface of the developing sleeve 440 between the magnetic pole N2 and the magnetic pole N3 and collected in the stirring chamber 41*b*.

It is configured so that when the magnetic poles N2 and N3 having the same polarities are provided to be adjacent to each other, there is almost no lines of magnetic flux therebetween and zero gauss is almost achieved. Thus, there is a position where the magnetic force is almost zero (zero-gauss area) between the magnetic pole N2 as the first magnetic pole and the magnetic pole N3 as the second magnetic pole. In the invention, the region where the magnetic force is almost zero means a region where a magnetic flux density is 50 gausses or less. This makes it possible to prevent that a large amount of developer exists in a vicinity of the regulating blade 46 and to reduce the stress on the developer. In the case of the present embodiment, the position where the magnetic force is almost zero is on a substantially horizontal line passing through the center of the developing sleeve 440 of FIG. 2 (at the position of almost three o'clock when the sectional surface of the developing sleeve 440 is represented as a clock). Note that, the position where the magnetic force is almost zero moves according to arrangement of the magnetic poles. When the sectional surface of the developing sleeve 440 is represented as a clock, it is desirable that the position is at any position in a range substantially from one o'clock to five o'clock, and it is more desirable that the position is at any position in a range from two o'clock to four o'clock. In other words, it is desirable that the position where the magnetic force is almost zero is at any position in a range of 30° to 150° clockwise from an upper end position of the developing sleeve 440 (position of twelve o'clock), and it is more desirable that the position is in a range of 60° to 120°. In the invention, by providing the magnetic poles N2 and N3 having the same polarity, the zero-gauss area is formed therebetween. However, also when a magnetic pole which has minute magnetic force and has a polarity different from that of the magnetic poles N2 and N3 is arranged between the magnetic poles N2 and N3, the similar zero-gauss area is able to be formed. Such a configuration may be adopted in the invention. Note that, the invention has a configuration in which also when the aforementioned magnetic pole which has minute magnetic force and has the different polarity is arranged between the magnetic poles having the same polarity, the magnetic poles having the same polarity are adjacent.

[Position of Apex of Partition Wall]

The developing device 4*a* of the present embodiment has the vertical stirring function-separated configuration as described above, and the developer is circulated between the developing chamber 41*a* and the stirring chamber 41*b* through the openings 41*d* and 41*e* at the both ends of the partition wall 41*c*. Thus, as illustrated in FIG. 3, as developer T goes toward the opening 41*d* through which the developer T is delivered from the developing chamber 41*a* to the stirring chamber 41*b*, an amount of the developer T existing in the developing chamber 41*a* is reduced. That is, the developer surface of the developer T is lowered. This means that since the first conveying screw 42 conveys the developer to the downstream side in the conveyance direction while supplying the developer to the developing sleeve 440, the amount of the developer decreases as being closer to the downstream side in the conveyance direction of the developer of the first conveying screw 42. As a result, the height of the developer surface of the developer T is lowered near the opening 41*d* of the first conveying screw 42 and the developer is difficult to be supplied to the developing sleeve 440, so that coating of the developer on the developing sleeve 440 becomes unstable in some cases.

Thus, in the present embodiment, as illustrated in FIG. 2, the partition wall 41*c* is extended to a position, where an apex 47*a* of the partition wall 41*c* is positioned below the position where the magnetic force is almost zero between the magnetic pole N2 and the magnetic pole N3, between the developing sleeve 440 and the first conveying screw 42. That is, the apex 47*a* of the rising portion 47 of the partition wall 41*c* is positioned to be lower than the position where the magnetic force is almost zero, and the apex 47*a* is positioned below the upper end position of the zero-gauss area. In other words, height of the apex 47*a* of the partition wall 41*c* between the first conveying screw 42 and the developing sleeve 440 is set to be below the region which is formed by the magnet roller 45 and where the magnetic force is almost zero. The height of the apex 47*a* is set to be the same throughout the axis direction of the developing sleeve 440. In addition, though the partition wall 41*c* is formed so that the position of the apex 47*a* is below a line α connecting the center of the developing sleeve 440 and the center of the first conveying screw 42, the position of the apex 47*a* may be above the line α. In short, the position of the apex 47*a* is only required to be below the position where the magnetic force is almost zero. However, when the position of the apex 47*a* is below the line α, the developer supplied from the developing chamber 41*a* to the developing sleeve 440 is more likely to fall down, so that a situation about falling down of the developer, which will be described below, becomes prominent.

Note that, the height of the apex 47*a* of the rising portion 47 of the partition wall 41*c* is ensured to be height by which the developer is able to be held sufficiently in the developing chamber 41*a*. That is, the height of the rising portion 47 is set so that an amount of the developer which is able to be sufficiently supplied to the developing sleeve 440 is able to be held while the first conveying screw 42 is stirring and conveying the developer to the developing chamber 41*a* formed between the partition wall 41*c* including the rising portion 47 and the developer container 41.

When the partition wall 41*c* between the developing chamber 41*a* and the developing sleeve 440 has the low height as described above, the amount of the developer supplied to the developing sleeve 440 from the developing chamber 41*a* is able to be increased. As a result, it is possible to supply sufficient developer to the developing sleeve 440 even in the downstream side of the conveyance direction of the developer by the first conveying screw 42 of the developing chamber 41*a*, in which the developer surface is low, and stabilize coating property of the developer of the developing sleeve 440.

Note that, in the case of the present embodiment, the vertical position of the rotational center of the first conveying screw 42 is below the vertical position of the rotational center of the developing sleeve 440. In other words, the developing sleeve 440 is arranged so that the center position thereof is above the center position of the first conveying screw 42. Thereby, the height of the position where the magnetic force of the magnet roller 45 arranged inside the developing sleeve 440 is almost zero is able to be set to be higher than the first conveying screw 42 as much as possible. As a result, the height of the position where the magnetic force of the magnet roller 45 is almost zero is easy to be higher than the position of the apex 47*a* of the partition wall 41*c*.

[Surface Shape of Developing Sleeve]

On the other hand, when a large amount of developer is supplied to the developing sleeve 440 as described above, the developer supplied to the developing sleeve 440 falls down if constraint force of the developer by the developing sleeve 440 is not ensured. That is, in the case of a configuration in which the developer is supplied to a position at which the magnetic flux density formed by the magnetic poles N2 and N3 is almost zero, there is a possibility that the developer is difficult to be sufficiently constrained by the developing sleeve 440 and falls down. When the developer falls into the stirring chamber 41*b* directly, an excessive amount of developer is accumulated in the stirring chamber 41*b*, so that density unevenness due to drag, and further, generation of overflow of the developer due to inappropriate collection of the developer on the developing sleeve 440 may occur.

As a shape of the surface of the developing sleeve, a configuration in which surface roughness is made high by applying random roughing treatment by blasting or the like has been conventionally known. However, in the case of such a developing sleeve on the surface of which microscopic unevenness is formed, when a period of use becomes long, the surface is scraped so that constraint force of the developer deteriorates. Therefore, in the case of such a configuration, as a period of use becomes long, a risk of falling down of the developer is increased.

[Developing Sleeve Opposed Member]

Thus, in the present embodiment, as illustrated in FIG. 2 and FIG. 4, an opposed member 47*b* is arranged so as to be in a vicinity of a position at which magnetic force is almost 0 between the magnetic pole N2 of a multipolar magnet 45 and the magnetic pole N3 next to the magnetic pole N2 in the upstream side. The opposed member 47*b* has surface roughness higher than an average particle diameter of carrier used in the present exemplary embodiment. This is because when the surface roughness is less than the average particle diameter of the carrier, the carrier becomes difficult to be constrained on the surface of the opposed member 47*b* and constraint property of the developer by the opposed member 47*b* is lowered. Moreover, the opposed member 47*b* has the surface roughness (average value) higher than those of the developing chamber 41*a* and the stirring chamber 41*b*.

For roughening the surface in the present exemplary embodiment, projecting portions are formed by blasting for obtaining desired surface roughness by blowing abrasive grains to the surface with a fixed pressure to form many projection and recess portions, but there is no limitation thereto. When changing the surface roughness, desired surface roughness is able to be obtained by adjusting a particle diameter of the abrasive grains, an ejection pressure of the abrasive grains, an ejection time of the abrasive grains, and the like.

As an index of the surface roughness, Rz (μm) was used. For measurement of the surface roughness, surface shape measuring microscopes VF-7500 and VF7510 manufactured by Keyence Corporation were used and an objective lens of 250 times to 1250 times was used. Measurement of the surface roughness Rz of the opposed member 47*b* was performed in a non-contact manner. Since the average particle diameter of the carrier was 40 μm in the present exemplary embodiment, so that the surface roughness Rz of 55 μm was used in the present exemplary embodiment.

In this manner, by performing surface processing as described above for the surface of the opposed member 47*b*, it is possible to constrain the developer entering between the developing sleeve 440 and the opposed member 47*b* to prevent the developer from falling down.

Figure 7:
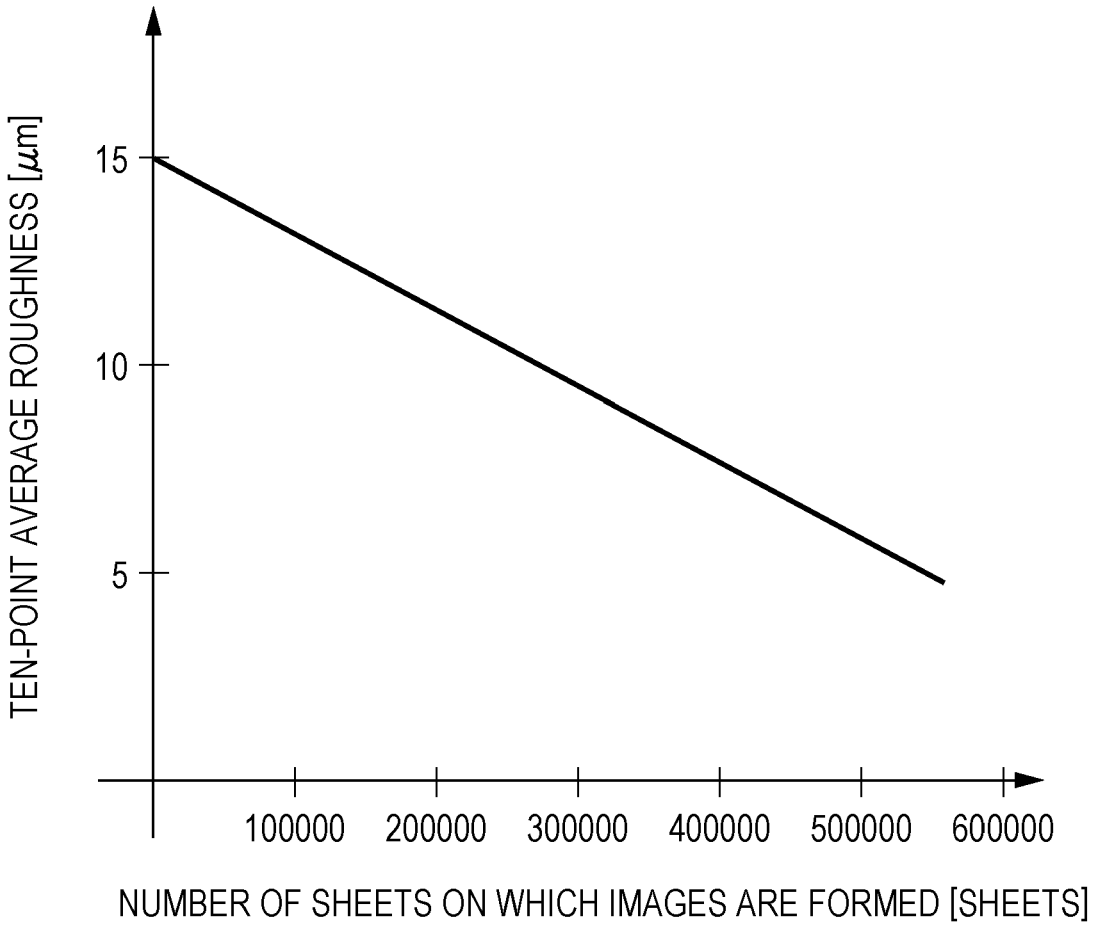
FIG. 7 illustrates relationships between surface roughness of a developing sleeve and the number of sheets on which images are formed.

Further, as illustrated in FIG. 7, a portion at which the magnetic force of the multipolar magnet 45 inside the developing sleeve 440 is large and which closely opposes the regulating member 46 or the photosensitive drum 1, the carrier constrained with the magnetic force and the surface of the developing sleeve 440 are frictionally slide strongly. Thus, when a period of use becomes long, wear of the surface of the developing sleeve 440 advances and the surface roughness is reduced. As a result, the constraint force of the developer is reduced, so that a risk of falling down of the developer is increased. On the other hand, since the opposed member 47*b* is arranged at the position where the magnetic force is almost zero between the magnetic pole N2 and the magnetic pole N3, even when a period of use becomes long, the wear hardly advances and large constraint force of the developer is able to be always maintained stably.

A distance between the opposed member 47*b* and the developing sleeve 440 is desired to be short as long as they do not make contact with each other. According to a result by examiners, it is found that in a case where the surface roughness of the opposed member 47*b* is 55 μm with the wear of the developing sleeve 440 advanced, when the distance is equal to or less than 1200 μm, the developer is able to be prevented from falling down. Thus, in the present exemplary embodiment, the distance between the opposed member 47*b* and the developing sleeve 440 is set to be 900 μm so that the developer is prevented from falling down.

On the other hand, a portion of the partition wall 41*c* other than the surface of the opposed member 47*b* has a possibility of causing image defects derived from an aggregate of the toner when the constraint force of the partition wall 41*c* is increased to a level by which the developer is constrained. This is because when the constraint force of the partition wall 41*c* is increased, a speed difference between a stationary part in which the developer does not move at all and a flowing part in which the developer is conveyed by the first conveying screw 42 or the second conveying screw 43 becomes great, resulting that the toner is likely to be separated in a boundary between the flowing layer and the stationary layer of the developer and an aggregate of the toner is generated more frequently. Therefore, the portion of the partition wall 41*c* other than the surface of the opposed member 47*b* is desired to have smaller surface roughness so as to reduce the constraint force as much as possible.

As described above, in the case of the present embodiment, the position of the apex 47*a* of the partition wall 41*c* is below the position where the magnetic force between the magnetic pole N2 and the magnetic pole N3 is almost zero. That is, the apex 47*a* is below the position of the upper end of the zero-gauss area. Thus, it is possible to increase the developer supplied to the developing sleeve 440 and stabilize coating property of the developer on the developing sleeve 440. In addition, the surface of the opposed member 47*b* has higher surface roughness than the average particle diameter of the carrier. Thus, the developer is able to be constrained by the opposed member 47*b*. Thereby, even when a large amount of developer enters from the developing chamber 41*a*, the developer is difficult to fall down to the stirring chamber 41*b*. This makes it possible to provide the developing device 4 in which neither density unevenness nor overflow of the developer are caused while ensuring the coating property of the developer on the developing sleeve 440.

Next, an experiment carried out for confirming effects of the present embodiment will be described. In the experiment, an example 1 as a configuration of the present embodiment described in FIG. 2 and the like above was compared to configurations of comparative examples 1 and 2 illustrated in FIG. 5 and FIG. 6. First, the configuration of the comparative example 1 will be described with reference to FIG. 5. In the case of a developing device 400 of the comparative example 1, conveyance characteristics on the surface of the developing sleeve 440 are ensured by applying random roughing treatment by blasting or the like for the surface of the developing sleeve 440 to make the surface roughness high. In addition, it is set that an apex 470*a* of a partition wall 410*c* between the first conveying screw 42 and the developing sleeve 440 has height to be at a position above a so-called zero-gauss area in which the magnetic force formed by the magnet roller 45 is almost zero. That is, the height of a rising portion 470 is made higher than that of the present embodiment so that the position in which the magnetic force is almost zero is below the apex 470*a*.

A reason therefor is as follows. Specifically, in the case of the comparative example 1 as well, the magnet roller 45 arranged inside the developing sleeve 440 has magnetic poles arranged in the same manner as the present embodiment. Therefore, at a position at which the magnetic flux density formed by the magnetic poles N2 and N3 is almost zero, the developer is difficult to be constrained by the developing sleeve 440 and directly falls down to the stirring chamber 41*b* easily. Particularly in the developing sleeve 440 obtained by process for making the surface roughness high by applying random roughing treatment like in the comparative example 1, the surface roughness or the like easily changes according to the number of sheets on which images are formed. Thus, as a period of use becomes long, developer conveying force of the developing sleeve 440 may be reduced. Thus, in the comparative example 1, the height of the apex 470*a* of the partition wall 410*c* is at a position above the so-called zero-gauss area in which the magnetic force formed by the magnet roller 45 is almost zero so that the developer is difficult to fall down to the stirring chamber 41*b*. Moreover, in the case of the comparative example 1 as well, similarly to the present embodiment an opposed member 470*b* is provided on the partition wall 410*c*, and the surface roughness of the opposed member 470*b* is smaller than the average particle diameter of the carrier. Other configurations are similar to those of the present embodiment.

Figure 6:
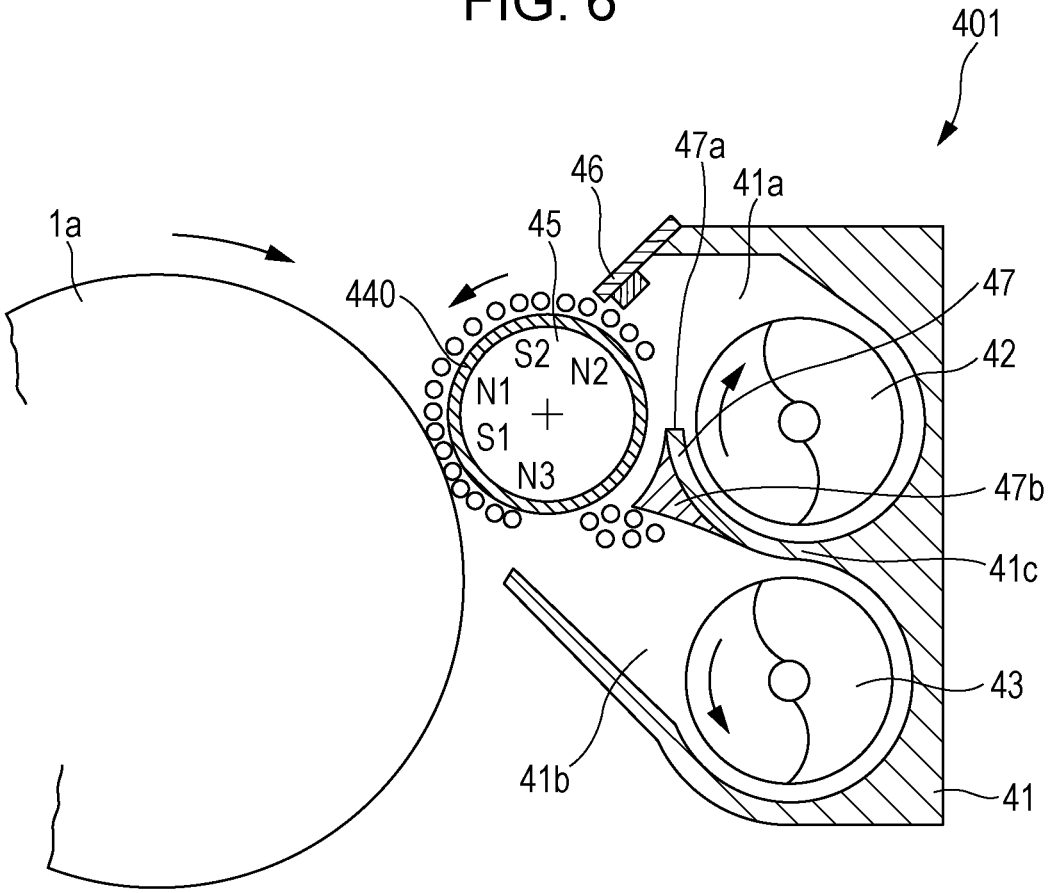
FIG. 6 is a transverse sectional view of a schematic configuration of a developing device according to a comparative example 2.

Next, the configuration of the comparative example 2 will be described with reference to FIG. 6. In the case of a developing device 401 of the comparative example 2, similarly to the comparative example 1, the surface roughness of the developing sleeve 440 is made high by applying random roughing treatment by blasting for the surface thereof. On the other hand, the apex 47*a* of the partition wall 41*c* between the first conveying screw 42 and the developing sleeve 440 has height to be positioned below the upper end of the so-called zero-gauss area in which the magnetic force formed by the magnet roller 45 is almost zero similarly to the present embodiment. In addition, in the case of the comparative example 2 as well, though the opposed member 470*b* is provided on the partition wall 41*c* similarly to the present embodiment, the surface roughness of the opposed member 470*b* is smaller than the average particle diameter of the carrier. Other configurations are similar to those of the present embodiment.

Figure 5:
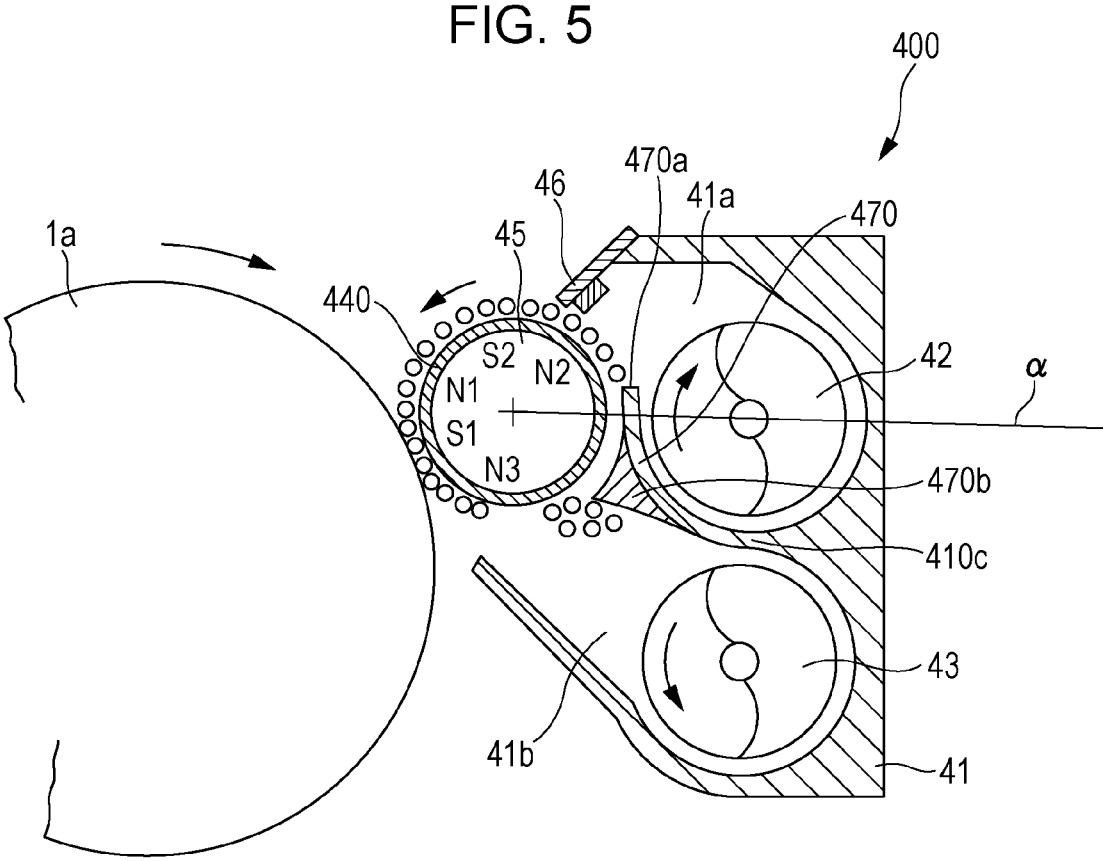
FIG. 5 is a transverse sectional view of a schematic configuration of a developing device according to a comparative example 1.

Comparative experiments as follows were carried out by incorporating each of the developing device 4*a* of the example 1 illustrated in FIG. 2 above, the developing device 400 of the comparative example 1 illustrated in FIG. 5, and the developing device 401 of the comparative example 2 illustrated in FIG. 6 into an image forming apparatus 100 as illustrated in FIG. 1. As an experimental condition, a ratio by weight of the toner to the carrier (T/D) in the developer at a time of start was set to 8%. With conditions such as an image ratio and an environment being equal, image formation was repeated on sheets of A4 paper. After that, the developing devices 400 and 401 were compared as to images and development. First, as a result of repeating the image formation on 200000 sheets under an environment with 25° C. and 50%, no particular situation was caused in all the developing devices.

Subsequently, as a result of repeating the image formation on 200000 sheets of A4 paper under an environment with 30° C. and 85%, in the middle of the image formation, the developing device 400 of the comparative example 1 caused density unevenness at a position corresponding to a downstream part in the conveyance direction of the first conveying screw 42. When the developing device 400 of the comparative example 1 was observed under such a situation, it could be seen that fluidity of the developer existing in the developing device 400 was lowered and the height of the developer surface in the downstream part in the conveyance direction of the first conveying screw 42 became lower compared to the height before the image formation was started. As a result, it was found that the developer could not be supplied to the developing sleeve 440 so that the density unevenness was caused due to unstable coating of the developer. According to further examination by inventors, it was found that the fluidity was likely to be changed to be lowered under an environment with high temperature and high humidity. No particular situation was caused in the developing devices 401 and 4*a* of the comparative example 2 and the example 1.

Subsequently, as a result of repeating the image formation on 200000 sheets of A4 paper under an environment with 20° C. and 10%, the density unevenness started to occur in the developing device 401 of the comparative example 2 in the middle of the image formation. After that, before reaching 200000 sheets, an image having the carrier adhered thereto was generated at a position corresponding to the upstream side in the conveyance direction of the first stirring screw 42. When the developing device 401 of the comparative example 2 was observed under such a situation, a large amount of developer was on the stirring chamber 41*b* side. It was found that the developer coating on the developing sleeve 440 existed to an extent such that the developer could not enter into the stirring chamber 41*b* when the developer is collected in the stirring chamber 41*b* after a development step ended at a position opposing the photosensitive drum 1*a*. After more observation, it was also found that a coating amount of the developer on the developing sleeve 440 was reduced. With observation of the surface of the developing sleeve 440, the surface roughness was made low and gloss appeared to be enhanced.

Thus, the surface roughness of the developing sleeve 440 was measured by using a roughness measuring machine of a contact type (Surfcorder SE3-300 manufactured by Kosaka Laboratory Ltd.) which is able to calculate ten-point average roughness Rz (JIS-B-0601:1994). The measurement condition was 0.8 mm in a cutoff value, 2.5 mm in a measurement length, 0.1 mm/sec in a conveyance speed, and 5000 times in longitudinal magnification. As a result, while Rz before the image formation was 15 μm, Rz when the image having the carrier adhered thereto was generated was 5 μm. In a case where the coating amounts of the developer when Rz of the developing sleeve 440 was 5 μm and when it was 15 μm were measured by using the developer before the image formation, it was found that the developing sleeve 440 with Rz of 5 μm had Rz reduced by about forty percent and had conveyance characteristics reduced by about forty percent. FIG. 7 illustrates relationships between the number of sheets on which images are formed and surface roughness of the developing sleeve 440. It is found that as the number of sheets on which images are formed increases, Rz is reduced and Rz is about 5 μm when the number of sheets is about 550000.

According to the experimental result of the comparative example 2, it was found that because of reduction in the conveyance characteristics of the developing sleeve 440, the developer could not conveyed by the developing sleeve 440 and passed through a space between the developing sleeve 440 and the opposed member 47*b* so that the developer fell down to the stirring chamber 41*b* side, resulting that a large amount of the developer is accumulated in the stirring chamber 41*b* side. It was further found that the developer was not taken in the stirring chamber 41*b* and overflew to cause the image having the carrier adhered thereto. Examination by the inventors revealed that there was almost no difference caused by the environment.

On the other hand, in the developing device 4*a* of the example 1, the coating amount of the developer on the developing sleeve 440 after the image formation on 600000 sheets was reduced similarly to the comparative example 2, and there was almost no difference between the example 1 and the comparative example 2. However, it could be seen that the amount of the developer existing in the stirring chamber 41*b* side had almost no change from the amount of the developer before the image formation. This is because setting the surface roughness Rz of the opposed member 47*b* to be equal to or more than the average particle diameter of the carrier as described above allows improvement in the constraint force of the developer and prevention of falling down of the developer. As a result, the developing device 401 of the example 1 had no particular situation, thus making it possible to provide a developing device in which neither density unevenness nor overflow of the developer occurs.

Second Embodiment

Figure 9:
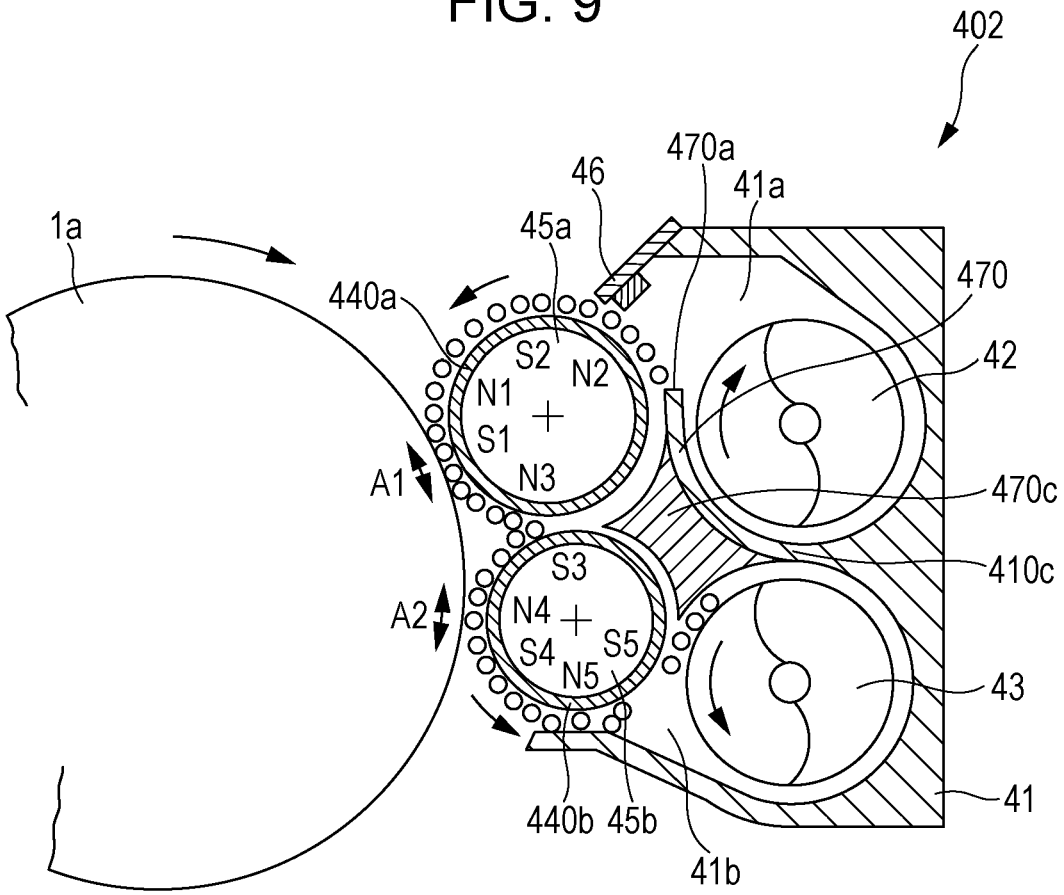
FIG. 9 is a transverse sectional view of a schematic configuration of a developing device according to a comparative example 3.
Figure 10:
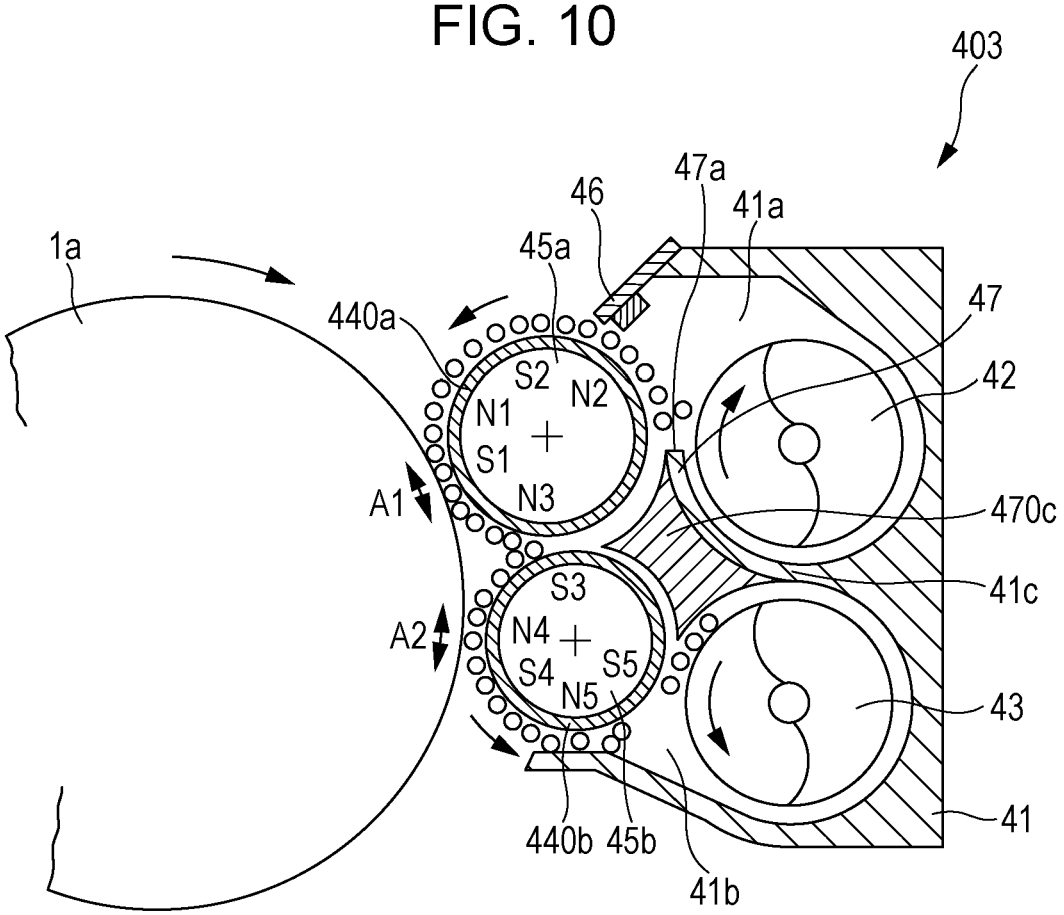
FIG. 10 is a transverse sectional view of a schematic configuration of a developing device according to a comparative example 4.

A second embodiment of the invention will be described with reference to FIG. 8 to FIG. 10. A developing device 403 of the present embodiment relates to a configuration employing a multi-stage developing method which allows increase in development opportunities. Specifically, a predetermined density is ensured by using a plurality of developing sleeves. More specifically, two developing sleeves are used in the present embodiment. Such a configuration is suitable to further increase speed of an image forming apparatus. Since other configurations and effects are similar to those of the first embodiment, illustration of the similar configurations will be omitted, or the same reference signs will be assigned thereto for omitting or simplifying the description. A difference from the first embodiment will be mainly described. Note that, in the present embodiment as well, though description will be given for the developing device 403 of the yellow image forming station Y (refer to FIG. 1), developing devices of other image forming stations also have a similar configuration.

Figure 8:
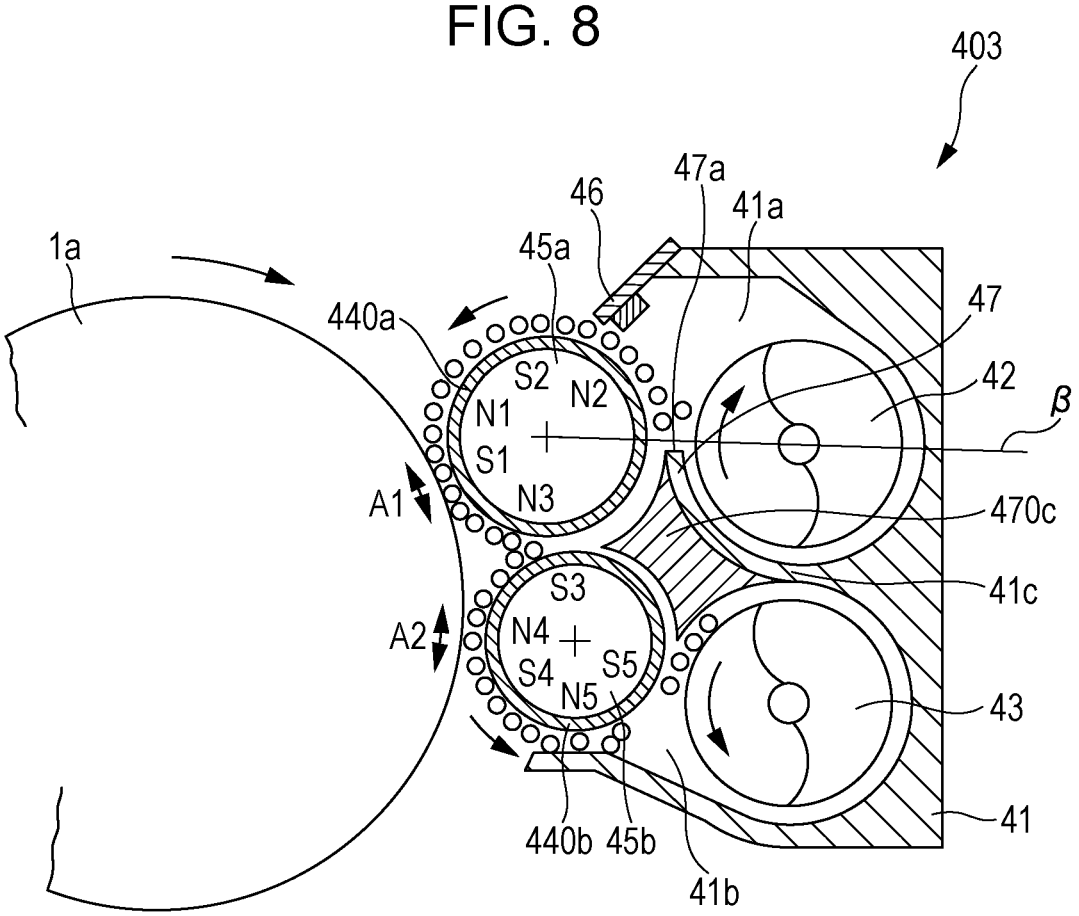
FIG. 8 is a transverse sectional view of a schematic configuration of a developing device according to a second embodiment of the invention.

As illustrated in FIG. 8, the developing device 403 of the present embodiment includes the developer container 41, and two-component developer including toner and carrier is contained in the developer container 41 as the developer. A developing sleeve 440*a* as a first developer bearing member, a developing sleeve 440*b* as a second developer bearing member, and the regulating blade 46 for regulating magnetic brush of the developer borne on the developing sleeve 440*a* are provided in the developer container 41. The developing sleeve 440*a* conveys the developer supplied from the developing chamber 41*a* by bearing it on the surface thereof. The developing sleeve 440*b* is provided below the developing sleeve 440*a* and conveys the developer delivered from the developing sleeve 440*a* by bearing it on the surface thereof. The developing sleeve 440*a* is arranged so that a center position thereof is above the center position of the first conveying screw 42. The first conveying screw 42 is arranged so that the center thereof is positioned between an upper end and a lower end of the developing sleeve 440*a*. In the present embodiment, the first conveying screw 42 is arranged being adjacent to the developing sleeve 440*a* in a substantially horizontal direction.

The developing sleeve 440*a* rotates in a direction indicated by an arrow in FIG. 8 (counterclockwise direction) at the time of development. Then, after the developer is supplied from the developing chamber 41*a* as the first chamber, the developing sleeve 440*a* bears thereon two-component developer whose layer thickness is regulated by chain-cutting of a magnetic brush by the regulating blade 46. The developing sleeve 440*a* conveys the two-component developer to a developing area A1 in which the developing sleeve 440*a* opposes the photosensitive drum 1*a*, and supplies the developer to an electrostatic latent image formed on the photosensitive drum 1*a*. On the other hand, the developing sleeve 440*b* rotates in a direction indicated by an arrow in FIG. 8 (counterclockwise direction) at the time of development. Then, the developer which has passed through the developing area A1 is delivered from the surface of the developing sleeve 440*a*. The developer delivered to the developing sleeve 440*b* is conveyed to a developing area A2 in the downstream side of the developing area A1 in the rotation direction of the photosensitive drum 1*a* and the developer is supplied again to the electrostatic latent image formed on the photosensitive drum 1*a* to develop the latent image. After that, the developer from the developing sleeve 440*b*, which has contributed to the development, is collected in the stirring chamber 41*b* as the second chamber.

In the present embodiment as well, similarly to the developing sleeve 440 of the first embodiment, the surface of the developing sleeve 440*a* is subjected to random roughing treatment by blasting. Moreover, the surface of the developing sleeve 440*b* is also subjected to random roughing treatment by blasting similarly. Note that, the developing sleeve 440*b* is not limited thereto.

A magnet roller 45*a* similar to the magnet roller 45 of the first embodiment is arranged in the developing sleeve 440*a*. A position at which a reference sign of each of magnetic poles is indicated in FIG. 8 indicates a position at which magnetic force of the corresponding magnetic pole substantially reaches peak. Similarly to the first embodiment, the magnetic pole N2 as the first magnetic pole is arranged so as to substantially oppose the regulating blade 46 and so that the peak position of the magnetic force is above the center of the developing sleeve 440*a*. In addition, the magnetic pole N3 as the second magnetic pole is arranged so as to be adjacent to the magnetic pole N2 in the upstream side and so that the peak position of the magnetic force is below the center of the developing sleeve 440*a*. In the case of the present embodiment, the magnetic poles N2 and N3 are arranged so that the center of the first conveying screw 42 is positioned between the magnetic pole N2 and the magnetic pole N3 which are repulsive poles in a vertical direction. In other words, the first conveying screw 42 is arranged so that the center thereof is below the peak position of the magnetic force of the magnetic pole N2 and above the peak position of the magnetic force of the magnetic pole N3. Similarly to the first embodiment, the partition wall 41*c* is extended to a position, where the apex 47*a* of the partition wall 41*c* is positioned below the position where the magnetic force is almost zero between the magnetic pole N2 and the magnetic pole N3, between the developing sleeve 440*a* and the first conveying screw 42. Further, the position where the magnetic force is almost zero is also similar to that of the first embodiment.

The partition wall 41*c* is formed so that the position of the apex 47*a* is below a line β connecting the center of the developing sleeve 440*a* and the center of the first conveying screw 42. Particularly in the case of a configuration having two developing sleeves as in the present embodiment, it is desired that the developing sleeve 440*b* is arranged to be positioned above the stirring chamber 41*b* as much as possible in consideration of collectability of the developer from the lower developing sleeve 440*b* to the stirring chamber 41*b*. For example, it is desired that the developing sleeve 440*b* is arranged so that the center position thereof is above the center position of the second conveying screw 43. Thereby, the position of the developing sleeve 440*a* arranged above the developing sleeve 440*b* is also made high, resulting that the position of the apex 47*a* is easily below the line β. In this case, the developer supplied from the developing chamber 41*a* to the developing sleeve 440*a* easily falls down to the stirring chamber 41*b* through a clearance between an opposed member 470*c* and the developing sleeve 440*a*. Thus, the situation about falling down of the developer to the stirring chamber 41*b* becomes more prominent in the configuration using two developing sleeves as in the present embodiment.

On the other hand, a magnet roller 45*b* is arranged in the developing sleeve 440*b*. The magnet roller 45*b* has a plurality of magnetic poles S3, S4, S5, N4, and N5. The magnetic pole N4 is a developing pole arranged in the developing unit opposing the photosensitive drum 1*a*. The magnetic pole S3 is arranged at a position substantially opposing the magnetic pole N3 of the magnet roller 45*a* in the developing sleeve 440*a*, and, at this position, the developer is delivered from the developing sleeve 440*a*. At this time, the developer delivered from the surface of the developing sleeve 440*a* to the developing sleeve 440*b* is not delivered successfully and passes between the developing sleeve 440*a* and the developing sleeve 440*b* to reach the developing chamber 41*a* in the developing device 403. Thereby, since the toner is consumed when the developer passes through the developing area A1 once, the developer whose toner density is reduced reaches the regulating blade 46 again so that density unevenness occurs. Alternatively, a situation can be assumed easily, for example, that a predetermined image density is not able to be ensured because developing performance is deteriorated due to decrease in the coating amount of the developer of the developing sleeve 440*b*. Therefore, it is needless to say that almost 100% of the developer is delivered from the surface of the developing sleeve 440*a* to the developing sleeve 440*b*. Specifically, the magnetic pole N3 of the developing sleeve 440*a*, which is associated with delivery, and the magnetic pole S3 of the developing sleeve 440*b*, which is associated with reception are positioned in such a manner that the magnetic pole S3 is arranged in the inner side of the developing device 403 than the magnetic pole N3, so that almost 100% of the developer is able to be delivered. The magnetic pole S5 is arranged being adjacent to the magnetic pole S3 in the upstream side of the rotation direction of the developing sleeve 440*b*. Thus, the developer borne on the developing sleeve 440*b* is separated from the surface of the developing sleeve 440*b* between the magnetic pole S5 and the magnetic pole S3 and collected in the stirring chamber 41*b*. The magnetic poles S4 and N5 are arranged between the magnetic pole S5 and the magnetic pole N4.

The partition wall 41*c* has the opposed member 470*c* provided so as to closely oppose the developing sleeve 440*a* and the developing sleeve 440*b*. The opposed member 470*c* is formed so as to protrude from a part extending from a middle portion of the partition wall 41*c* to the rising portion 47 toward the developing sleeve 440*a* and the developing sleeve 440*b*. In addition, the opposed member 470*c* has a surface opposing the surface of the developing sleeve 440*a* curved along a circumferential surface of the developing sleeve 440*a* and has a surface opposing the surface of the developing sleeve 440*b* curved along the surface of the developing sleeve 440*b*. In addition, the opposed member 470*c* opposes the developing sleeve 440*a* and the developing sleeve 440*b*, respectively at a position between the adjacent magnetic pole N2 and magnetic pole N3 which have the same polarity and at a position between the adjacent magnetic pole S5 and magnetic pole S3 which have the same polarity. This makes it possible to narrow a gap between the partition wall 41*c* and each of the developing sleeve 440*a* and the developing sleeve 440*b* so that the developer supplied from the developing chamber 41*a* to the developing sleeve 440*a* is difficult to fall down to the stirring chamber 41*b*. Further, the surface of the opposed member 470*c* which is also a feature of the present embodiment has higher surface roughness than the average particle diameter of the carrier. Thereby, similarly to the first embodiment, it is possible to constrain the developer entering between the developing sleeve 440*a* and the opposed member 470*c* to prevent the developer from falling down.

In the present embodiment as well, the position of the apex 47*a* of the partition wall 41*c* is below the position where the magnetic force is almost zero between the magnetic pole N2 and the magnetic pole N3. This makes it possible to increase the developer to be supplied to the developing sleeve 440*a* and stabilize coating property of the developer on the developing sleeve 440*a*. In addition, when the surface roughness of the surface of the opposed member 470*c* is made higher than the average particle diameter of the carrier as described above, the developer is easily constrained, and even when a large amount of developer is supplied from the developing chamber 41*a* to the developing sleeve 440*a*, the developer is difficult to fall down to the stirring chamber 41*b*. In particular, even in the case of a configuration where two developing sleeves are provided, the upper developing sleeve 440*a* is positioned high, and the position of the apex 47*a* is below the line β as in the present embodiment, it is possible to prevent the developer from falling down. As a result, it is possible to provide the developing device 401 in which neither density unevenness nor overflow of the developer is caused while ensuring coating property of the developer on the developing sleeve 440*a*.

Next, an experiment carried out for confirming effects of the present embodiment will be described. In the experiment, an example 2 as a configuration of the present embodiment described in FIG. 8 was compared to configurations of comparative examples 3 and 4 illustrated in FIG. 9 and FIG. 10, respectively. First, the configuration of the comparative example 3 will be described with reference to FIG. 9. In the case of a developing device 402 of the comparative example 3, conveyance characteristics on the surfaces of the developing sleeves 440*a* and 440*b* are ensured by applying random roughing treatment by blasting for the surfaces of the developing sleeves 440*a* and 440*b* to make the surface roughness high. In addition, it is set that the apex 470*a* of the partition wall 410*c* between the first conveying screw 42 and the developing sleeve 440*a* has height to be at a position above a so-called zero-gauss area in which the magnetic force formed by the magnet roller 45*a* is almost zero. That is, the height of the rising portion 470 is made higher than that of the present embodiment so that the position in which the magnetic force is almost zero is below the apex 470*a*. In the case of the comparative example 3 as well, similarly to the present embodiment, the opposed member 470*c* is provided on the partition wall 410*c* and the surface roughness is lower than the average particle diameter of the carrier. Other configurations are similar to those of the present embodiment.

Next, the configuration of the comparative example 4 will be described with reference to FIG. 10. In the case of a developing device 403 of the comparative example 4, similarly to the comparative example 3, the surface roughness of the developing sleeves 440*a* and 440*b* is made high by applying random roughing treatment by blasting for the surfaces thereof. On the other hand, the apex 47*a* of the partition wall 41*c* between the first conveying screw 42 and the developing sleeve 440*a* has height to be at a position below the so-called zero-gauss area in which the magnetic force formed by the magnet roller 45 is almost zero similarly to the present embodiment. In addition, in the case of the comparative example 4 as well, similarly to the present embodiment, the opposed member 470*c* is provided on the partition wall 41*c*, and the surface roughness is lower than the average particle diameter of the carrier. Other configurations are similar to those of the present embodiment.

A comparative experiment as follows was carried out by incorporating each of the developing device 403 of the example 2 illustrated in FIG. 8, the developing device 402 of the comparative example 3 illustrated in FIG. 9, and the developing device 403 of the comparative example 4 illustrated in FIG. 10 into the image forming apparatus 100 as illustrated in FIG. 1. As an experimental condition, a ratio by weight of the toner to the carrier (T/D) in the developer at a time of start was set to 8%. With conditions such as an image ratio and an environment being equal, image formation was repeated on sheets of A4 paper. After that, the developing devices 402 and 403 were compared as to images and development.

First, the developing device 402 of the comparative example 3 (FIG. 9) caused density unevenness under a high temperature and high humidity environment. In the developing device 403 of the comparative example 4 (FIG. 10), when the number of sheets on which images were formed increases, a rough image is provided first and an image having the carrier adhered thereto is then caused at a position corresponding to an upstream side in the conveyance direction of the first conveying screw 42. When the developing device 403 of the comparative example 4 was observed under such a situation, the amount of the developer coating on the developing sleeve 440*b* increased almost threefold compared to the amount of the developer before the image formation. It was found that developer stagnation occurred in the area A2, in which the photosensitive drum 1*a* and the developing sleeve 440*b* are most proximate to each other, and the developer overflew. It was further found that the surface roughness of the developing sleeve 440*a* was reduced to about 5 μm.

This is because the developer which fell down after passing through a portion between the developing sleeve 440*a* and the opposed member 470*c* provided near the zero-gauss area passed through a portion between the developing sleeve 440*a* and the developing sleeve 440*b* and was supplied to the developing sleeve 440*b*. That is, the developer supplied to the developing sleeve 440*b* in this manner joined the developer delivered from the developing sleeve 440*a* to the developing sleeve 440*b* in a normal route so that the coating amount of the developer on the developing sleeve 440*b* increased. As a result, the coating amount increased almost threefold and the developer was not allowed to pass through the part where the photosensitive drum 1*a* and the developing sleeve 440*b* are most proximate to each other, so that the image having the carrier adhered thereto occurred.

On the other hand, the developing device 403 of the example 2 (FIG. 8) had no particular situation, thus making it possible to provide a developing device in which neither density unevenness nor overflow of the developer occurs.

Other Embodiment

In the embodiments described above, the surfaces of the opposed members 47*b* and 470*c* are subjected to random roughing treatment by blasting or the like.

Figure 11A:
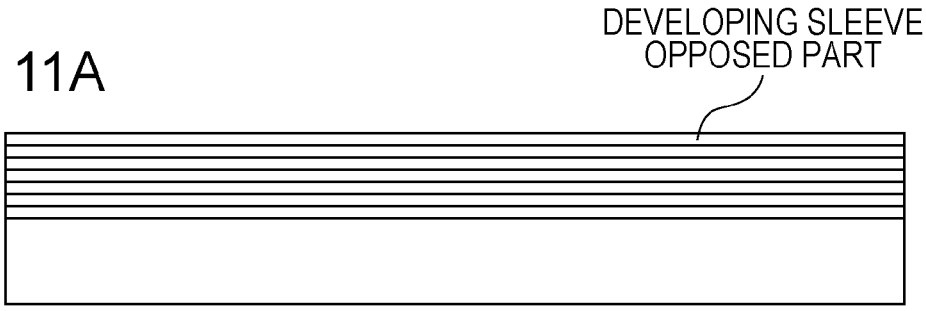
FIG. 11A to 11D are plan views illustrating a first example, a second example, a third example, and a fourth example of an opposed member according to another embodiment of the invention.

However, without limitation to the random roughing treatment, such surfaces of the opposed members 47*b* and 470*c* may have other shapes as long as being the surface shapes allowing ensuring of the constraint force by which the developer is able to be prevented from falling down. For example, as illustrated in FIG. 11A, a plurality of groove portions may be formed as a plurality of recess portions on the surface of the developing sleeve 44. In addition, intervals between the plurality of recess portions may be equal to or more than the largest diameter of the inscribed circles of opening shapes of the recess portions.

Figure 11B:
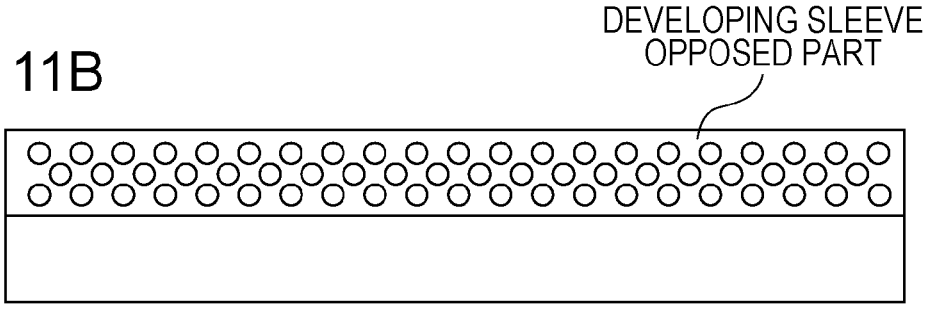
Figure 11C:
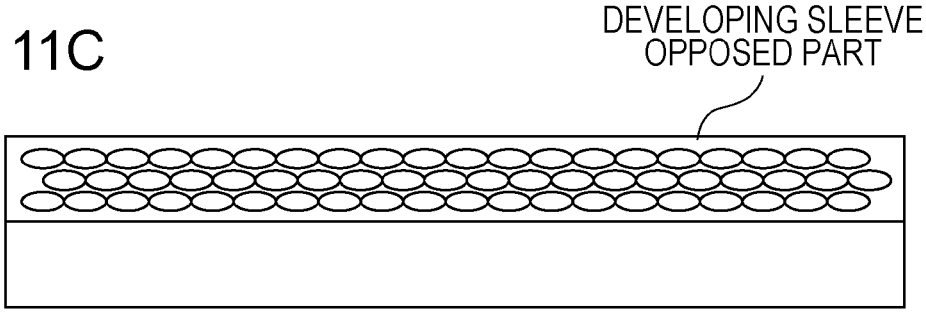
Figure 11D:
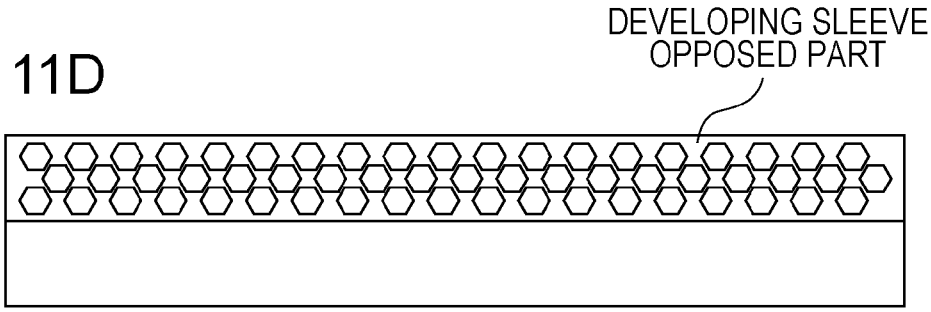

As illustrated in FIG. 11B, recess portions whose opening shapes are circular may be formed on the surface of the developing sleeve 44. In addition, as illustrated in FIG. 11C, recess portions whose opening shapes are elliptical may be formed on the surface of the developing sleeve 44. Further, as illustrated in FIG. 11D, recess portions whose opening shapes are polygonal may be formed on the surface of the developing sleeve 44. The groove portions and the recess portions are formed so as to provide larger constraint force than the constraint force provided by the surface roughness which is equal to or more than the average particle diameter of the carrier. In the present exemplary embodiment, the groove portions and the recess portions have the opening shapes whose largest diameter of the inscribed circles is equal to or more than the diameter of the average particle diameter of the carrier. The groove portions and the recess portions are formed so that the carrier with the average particle diameter is able to enter into the groove portions or the recess portions by radius or more.

In addition, as specific sectional shapes of the groove portions and the recess portions illustrated in FIGS. 11A to 11D, V-shapes and other shapes may be used. For example, the sectional shapes may be curved shapes or may be recessed shapes each having a bottom surface and a side wall surrounding the bottom surface.

In each of the embodiments described above, the configuration in which the regulating blade 46 as the regulating member is arranged at a position opposing the magnetic pole N2 as the first magnetic pole has been described. Such a configuration is provided in order to prevent a large amount of developer from existing near the regulating blade 46 and reduce the stress on the developer as described above. However, the developing device of the invention is able to be applied not only to such a configuration but also to the configuration in which the regulating blade 46 opposes, for example, the magnetic pole S2 of FIG. 2. That is, the invention is able to be applied to any configuration as long as being the configuration in which the first magnetic pole is arranged at a position opposing the regulating blade 46 or in the upstream side of the rotation direction of the developing sleeve 44 with respect to this position and the second magnetic pole which is adjacent to the first magnetic pole in the upstream side and has the same polarity as that of the first magnetic pole is arranged.

The material of the photosensitive drums used in the image forming apparatus according to each of the embodiments above, the developer, the configuration of the image forming apparatus, and the like are not limited to the foregoing. It is needless to say that the invention is able to be applied to various types of developer and image forming apparatuses. Specifically, the colors and the number of colors of the toners, the presence or absence of wax, the order of development of the color toners, the number of the first and second conveying screws, and the like are not limited to the aforementioned description. For example, the invention is able to be applied even to a developing device of other types, such as a function-separated developing device in which first and second conveying screws are arranged with a slight angle in a vertical direction.

Further, the image forming apparatus using the developing device of the invention is an image forming apparatus which forms an image by using an electrophotographic method, and is able to be applied, in particular, to a copier, a printer, a facsimile machine, a multi-function machine having functions thereof, or the like.

As described above, according to the invention, since the position of the apex of the partition wall is below a position where the magnetic force is almost zero between the first magnetic pole and the second magnetic pole, it is possible to increase the developer to be supplied to the developer bearing member and stabilize the coating property of the developer on the developer bearing member. In addition, since the opposed member is arranged along the developer bearing member at a position where the magnetic force is almost zero between the first magnetic pole and the second magnetic pole and the surface of the opposed member has roughness higher than the average particle diameter of the carrier or more, the developer is easily constrained by the opposed member. Thereby, even when a large amount of developer flows from the first chamber into a part between the developer bearing member and the opposed member, the developer is difficult to fall down to the second chamber.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-100289, filed on May 15, 2015 which is hereby incorporated by reference herein in its entirety.

What is claimed is:

1. A developing device, comprising:

a developer bearing member configured to bear developer including nonmagnetic toner and magnetic carrier and develops a latent image;

a developer container configured to support the developer bearing member rotatably and contain therein the developer to be supplied to the developer bearing member, the developer container having a first chamber containing the developer therein, a second chamber being arranged below the first chamber and forming a circulation path, in which the developer is circulated, with the first chamber, and a partition wall partitioning the first chamber and the second chamber;

a first conveying member, arranged in the first chamber rotatably, configured to convey the developer;

a second conveying member, arranged in the second chamber, configured to convey the developer;

a multipolar magnet which is arranged inside the developer bearing member; and a regulating member configured to regulate an amount of the developer borne on the developer bearing member;

the multipolar magnet having a first magnetic pole which is arranged at a position opposing the regulating member or in an upstream side of a conveyance direction of the developer bearing member with respect to the position, and a second magnetic pole which is adjacent to the first magnetic pole in an upstream side of the first magnetic pole in the conveyance direction, and has the same polarity as that of the first magnetic pole, wherein a peak position of magnetic force of the first magnetic pole is arranged above a rotational center of the developer bearing member, and a peak position of magnetic force of the second magnetic pole is arranged below the rotational center of the developer bearing member, wherein a rotational center of the first conveying member is arranged below the peak position of the magnetic force of the first magnetic pole and above the peak position of the magnetic force of the second magnetic pole, wherein an opposed surface of the partition wall facing the developer bearing member has a concave-arc-shaped opposed portion formed along a circumferential surface of the developer bearing member, and a clearance between the opposed portion and the circumferential surface of the developer bearing member facing the opposed portion is 1,200 μm or less, wherein the opposed portion having an apex positioned below a minimal position at which magnetic force is the smallest in a zone in which magnetic force on the surface of the developer bearing member is equal to or less than 50 gauss and above a peak position of magnetic force of the second magnetic pole, the zone being provided on a surface of the developer bearing member which is on an upstream side of the first magnetic pole and on a downstream side of the second magnetic pole with respect to a rotation direction of the developer bearing member, and wherein the opposed surface has a surface roughness Rz higher than an average particle diameter of the carrier.

2. The developing device according to claim 1, wherein the multipolar magnet is arranged at a position where the first magnetic pole opposes the regulating member.

3. The developing device according to claim 1, wherein the partition wall is formed so that the position of the apex is below a line connecting the rotational center of the developer bearing member and the rotational center of the first conveying member.

4. The developing device according to claim 1, wherein the rotational center of the developer bearing member is arranged above the rotational center of the first conveying member.

5. The developing device according to claim 1, wherein a plurality of grooves is formed, in a direction that intersects the rotation direction, on a surface of the developer bearing member at an interval in the rotation direction, and each of the plurality of grooves having an opening shape whose largest diameter of an inscribed circle is equal to or more than a diameter of an average particle diameter of the carrier and having a depth equal to or more than a radius of the average particle diameter of the carrier.

6. The developing device according to claim 1, wherein a plurality of concaved portions is formed on a surface of the developer bearing member at an interval, and each of the plurality of concaved portions having an opening shape whose largest diameter of an inscribed circle is equal to or more than a diameter of an average particle diameter of the carrier and having a depth equal to or more than a radius of the average particle diameter of the carrier.

7. A developing device, comprising:

a developer bearing member configured to bear developer including nonmagnetic toner and magnetic carrier and develops a latent image;

a developer container configured to support the developer bearing member rotatably and contain therein the developer to be supplied to the developer bearing member, the developer container having a first chamber containing the developer therein, a second chamber being arranged below the first chamber and forming a circulation path, in which the developer is circulated, with the first chamber, and a partition wall partitioning the first chamber and the second chamber;

a first conveying member, arranged in the first chamber rotatably, configured to convey the developer;

a second conveying member, arranged in the second chamber, configured to convey the developer;

a multipolar magnet which is arranged inside the developer bearing member; and a regulating member configured to regulate an amount of the developer borne on the developer bearing member;

the multipolar magnet having a first magnetic pole which is arranged at a position opposing the regulating member or in an upstream side of a conveyance direction of the developer bearing member with respect to the position, and a second magnetic pole which is adjacent to the first magnetic pole in an upstream side of the first magnetic pole in the conveyance direction, and has the same polarity as that of the first magnetic pole, wherein a peak position of magnetic force of the first magnetic pole is arranged above a rotational center of the developer bearing member, and a peak position of magnetic force of the second magnetic pole is arranged below the rotational center of the developer bearing member, wherein a rotational center of the first conveying member is arranged below the peak position of the magnetic force of the first magnetic pole and above the peak position of the magnetic force of the second magnetic pole, wherein an opposed surface of the partition wall facing the developer bearing member has a concave-arc-shaped opposed portion formed along a circumferential surface of the developer bearing member, and a clearance between the opposed portion and the circumferential surface of the developer bearing member facing the opposed portion is 1,200 μm or less, wherein the opposed portion having an apex positioned below a minimal position at which magnetic force is the smallest in a zone in which magnetic force on the surface of the developer bearing member is equal to or less than 50 gauss and above a peak position of magnetic force of the second magnetic pole, the zone being provided on a surface of the developer bearing member which is on an upstream side of the first magnetic pole and on a downstream side of the second magnetic pole with respect to a rotation direction of the developer bearing member, and wherein the opposed portion having a surface on which a plurality of recessed portions are formed at an interval, and each of the plurality of recessed portions having an opening shape whose largest diameter of an inscribed circle is equal to or more than a diameter of an average particle diameter of the carrier and having a depth equal to or more than a radius of the average particle diameter of the carrier.

8. The developing device according to claim 7, wherein a plurality of grooves is formed, in a direction that intersects the rotation direction, on a surface of the developer bearing member at an interval in the rotation direction, and each of the plurality of grooves having an opening shape whose largest diameter of an inscribed circle is equal to or more than a diameter of an average particle diameter of the carrier and having a depth equal to or more than a radius of the average particle diameter of the carrier.

9. The developing device according to claim 7, wherein a plurality of concaved portions is formed on a surface of the developer bearing member at an interval, and each of the plurality of concaved portions having an opening shape whose largest diameter of an inscribed circle is equal to or more than a diameter of an average particle diameter of the carrier and having a depth equal to or more than a radius of the average particle diameter of the carrier.

10. A developing device, comprising:

a first developer bearing member configured to bear developer including nonmagnetic toner and magnetic carrier and develop a latent image;

a second developer bearing member, provided opposing the first developer bearing member, configured to develop the latent image, developed by the first developer bearing member and receive the developer from the first developer bearing member;

a developer container configured to support the first developer bearing member and the second developer bearing member rotatably and contain therein the developer to be supplied to the first developer bearing member and the second developer bearing member, the developer container having a first chamber containing the developer therein, a second chamber being arranged below the first chamber and forming a circulation path, in which the developer is circulated, with the first chamber, and a partition wall partitioning the first chamber and the second chamber;

a first conveying member, arranged in the first chamber rotatably, configured to convey the developer;

a second conveying member, arranged in the second chamber configured to convey the developer;

a multipolar magnet which is arranged inside the first developer bearing member; and a regulating member configured to regulate an amount of the first developer borne on the first developer bearing member;

the multipolar magnet having a first magnetic pole which is arranged at a position opposing the regulating member or in an upstream side of a conveyance direction of the first developer bearing member with respect to the position, and a second magnetic pole which is adjacent to the first magnetic pole in an upstream side of the first magnetic pole in the conveyance direction, and has the same polarity as that of the first magnetic pole, wherein a peak position of magnetic force of the first magnetic pole is arranged above a rotational center of the first developer bearing member, and a peak position of magnetic force of the second magnetic pole is arranged below the rotational center of the first developer bearing member, wherein a rotational center of the first conveying member is arranged below the peak position of the magnetic force of the first magnetic pole and above the peak position of the magnetic force of the second magnetic pole, wherein an opposed surface of the partition wall facing the first developer bearing member has a concave-arc-shaped opposed portion formed along a circumferential surface of the first developer bearing member, and a clearance between the opposed portion and the circumferential surface of the first developer bearing member facing the opposed portion is 1,200 μm or less, wherein the opposed portion having an apex positioned below a minimal position at which magnetic force is the smallest in a zone in which magnetic force on the surface of the first developer bearing member is equal to or less than 50 gauss and above a peak position of magnetic force of the second magnetic pole, the zone being provided on a surface of the first developer bearing member which is on an upstream side of the first magnetic pole and on a downstream side of the second magnetic pole with respect to a rotation direction of the first developer bearing member, and wherein the opposed surface has a surface roughness Rz higher than an average particle diameter of the carrier.

11. The developing device according to claim 10, wherein the multipolar magnet is arranged at a position where the first magnetic pole opposes the regulating member.

12. The developing device according to claim 10, wherein the partition wall is formed so that the position of the apex is below a line connecting the rotational center of the first developer bearing member and the rotational center of the first conveying member.

13. The developing device according to claim 10, wherein the rotational center of the first developer bearing member is arranged above the rotational center of the first conveying member.

14. The developing device according to claim 10, wherein a plurality of grooves is formed, in a direction that intersects the rotation direction, on a surface of the first developer bearing member at an interval in the rotation direction, and each of the plurality of grooves having an opening shape whose largest diameter of an inscribed circle is equal to or more than a diameter of an average particle diameter of the carrier and having a depth equal to or more than a radius of the average particle diameter of the carrier.

15. The developing device according to claim 10, wherein a plurality of concaved portions is formed on a surface of the first developer bearing member at an interval, and each of the plurality of concaved portions having an opening shape whose largest diameter of an inscribed circle is equal to or more than a diameter of an average particle diameter of the carrier and having a depth equal to or more than a radius of the average particle diameter of the carrier.

16. A developing device, comprising:

a first developer bearing member configured to bear developer including nonmagnetic toner and magnetic carrier and develop a latent image;

a second developer bearing member, provided opposing the first developer bearing member, configured to develop the latent image, developed by the first developer bearing member and receive the developer from the first developer bearing member;

a developer container configured to support the first developer bearing member and the second developer bearing member rotatably and contain therein the developer to be supplied to the first developer bearing member and the second developer bearing member, the developer container having a first chamber containing the developer therein, a second chamber being arranged below the first chamber and forming a circulation path, in which the developer is circulated, with the first chamber, and a partition wall partitioning the first chamber and the second chamber;

a first conveying member, arranged in the first chamber rotatably, configured to convey the developer;

a second conveying member, arranged in the second chamber, configured to convey the developer;

a multipolar magnet which is arranged inside the first developer bearing member; and a regulating member configured to regulate an amount of the first developer borne on the first developer bearing member;

the multipolar magnet having a first magnetic pole which is arranged at a position opposing the regulating member or in an upstream side of a conveyance direction of the first developer bearing member with respect to the position, and a second magnetic pole which is adjacent to the first magnetic pole in an upstream side of the first magnetic pole in the conveyance direction, and has the same polarity as that of the first magnetic pole, wherein a peak position of magnetic force of the first magnetic pole is arranged above a rotational center of the first developer bearing member, and a peak position of magnetic force of the second magnetic pole is arranged below the rotational center of the first developer bearing member, wherein an opposed surface of the partition wall facing the first developer bearing member has a concave-arc-shaped opposed portion formed along a circumferential surface of the first developer bearing member, and a clearance between the opposed portion and the circumferential surface of the first developer bearing member facing the opposed portion is 1,200 μm or less, wherein the opposed portion having an apex positioned below a minimal position at which magnetic force is the smallest in a zone in which magnetic force on the surface of the first developer bearing member is equal to or less than 50 gauss and above a peak position of magnetic force of the second magnetic pole, the zone being provided on a surface of the first developer bearing member which is on an upstream side of the first magnetic pole and on a downstream side of the second magnetic pole with respect to a rotation direction of the first developer bearing member, wherein the opposed portion having a surface on which a plurality of recessed portions are formed at an interval, and each of the plurality of recessed portions having an opening shape whose largest diameter of an inscribed circle is equal to or more than a diameter of an average particle diameter of the carrier and having a depth equal to or more than a radius of the average particle diameter of the carrier.

17. The developing device according to claim 16, wherein a plurality of grooves is formed, in a direction that intersects the rotation direction, on a surface of the first developer bearing member at an interval in the rotation direction, and each of the plurality of grooves having an opening shape whose largest diameter of an inscribed circle is equal to or more than a diameter of an average particle diameter of the carrier and having a depth equal to or more than a radius of the average particle diameter of the carrier.

18. The developing device according to claim 16, wherein a plurality of concaved portions is formed on a surface of the first developer bearing member at an interval, and each of the plurality of concaved portions having an opening shape whose largest diameter of an inscribed circle is equal to or more than a diameter of an average particle diameter of the carrier and having a depth equal to or more than a radius of the average particle diameter of the carrier.

* * * * *